US012544618B2

(12) United States Patent
Taylor et al.

(10) Patent No.: US 12,544,618 B2
(45) Date of Patent: Feb. 10, 2026

(54) LIFT MECHANISM FOR AN EXERCISE DEVICE

(71) Applicant: iFIT Inc., Logan, UT (US)

(72) Inventors: Keith A. Taylor, Plain City, UT (US); Trenton Von Larsen, Hyrum, UT (US); Tyler Fallentine, Providence, UT (US); Luke Downs, Smithfield, UT (US)

(73) Assignee: iFIT, Inc., Logan, UT (US)

( * ) Notice: Subject to any disclaimer, the term of this patent is extended or adjusted under 35 U.S.C. 154(b) by 367 days.

(21) Appl. No.: 18/082,162

(22) Filed: Dec. 15, 2022

(65) Prior Publication Data

US 2023/0191189 A1 Jun. 22, 2023

Related U.S. Application Data

(60) Provisional application No. 63/290,455, filed on Dec. 16, 2021.

(51) Int. Cl.

| | |
|---|---|
| ***A63B 22/00*** | (2006.01) |
| ***A63B 22/02*** | (2006.01) |
| ***A63B 71/06*** | (2006.01) |

(52) U.S. Cl.

CPC ..... *A63B 22/0023* (2013.01); *A63B 22/02* (2013.01); *A63B 2071/0675* (2013.01)

(58) Field of Classification Search

CPC ..... A63B 22/0023; A63B 22/02; A63B 2071/0675; A63B 21/225; A63B 22/0605; A63B 2022/0676; A63B 2225/093; A63B 22/025

See application file for complete search history.

(56) References Cited

U.S. PATENT DOCUMENTS

| | | | |
|---|---|---|---|
| 3,123,646 | A | 3/1964 | Easton |
| 3,579,339 | A | 5/1971 | Chang et al. |
| 4,023,795 | A | 5/1977 | Pauls |
| 4,300,760 | A | 11/1981 | Bobroff |
| D286,311 | S | 10/1986 | Martinell et al. |
| 4,681,318 | A | 7/1987 | Lay |
| 4,684,126 | A | 8/1987 | Dalebout et al. |
| 4,728,102 | A | 3/1988 | Pauls |
| 4,750,736 | A | 6/1988 | Watterson |
| 4,796,881 | A | 1/1989 | Watterson |
| 4,813,667 | A | 3/1989 | Watterson |
| 4,830,371 | A | 5/1989 | Lay |

(Continued)

OTHER PUBLICATIONS

U.S. Appl. No. 17/066,485, filed Oct. 9, 2020, Weston et al.

(Continued)

*Primary Examiner* — Loan B Jimenez
*Assistant Examiner* — Jacqueline N L Loberiza
(74) *Attorney, Agent, or Firm* — Holland & Hart LLP

(57) ABSTRACT

An incline mechanism for a treadmill includes a threaded rod supported by an upright structure. The threaded rod and a lift motor are connected to the upright support above the front end of an exercise deck. The threaded rod is threaded onto a threaded coupler. The threaded coupler is connected to a lift trolley connected to the front end of the exercise deck. As the lift motor rotates the threaded rod, the threaded coupler may move along the length of the threaded rod, thereby changing the inclination of the exercise deck.

15 Claims, 11 Drawing Sheets

(56) References Cited

U.S. PATENT DOCUMENTS 4,844,451 A 7/1989 Bersonnet et al.
4,850,585 A 7/1989 Dalebout et al.
D304,849 S 11/1989 Watterson
4,880,225 A 11/1989 Lucas et al.
4,883,272 A 11/1989 Lay
D306,468 S 3/1990 Watterson
D306,891 S 3/1990 Watterson
4,913,396 A 4/1990 Dalebout et al.
D307,614 S 5/1990 Bingham et al.
D307,615 S 5/1990 Bingham et al.
4,921,242 A 5/1990 Watterson
4,932,650 A 6/1990 Bingham et al.
D309,167 S 7/1990 Griffin
D309,485 S 7/1990 Bingham et al.
4,938,478 A 7/1990 Lay
D310,253 S 8/1990 Bersonnet et al.
4,955,599 A 9/1990 Bersonnet et al.
4,971,316 A 11/1990 Dalebout et al.
D313,055 S 12/1990 Watterson
4,974,832 A 12/1990 Dalebout
4,979,737 A 12/1990 Kock
4,981,294 A 1/1991 Dalebout et al.
D315,765 S 3/1991 Measom et al.
4,998,725 A 3/1991 Watterson et al.
5,000,442 A 3/1991 Dalebout et al.
5,000,443 A 3/1991 Dalebout et al.
5,000,444 A 3/1991 Dalebout et al.
D316,124 S 4/1991 Dalebout et al.
5,013,033 A 5/1991 Watterson et al.
5,014,980 A 5/1991 Bersonnet et al.
5,016,871 A 5/1991 Dalebout et al.
D318,085 S 7/1991 Jacobson et al.
D318,086 S 7/1991 Bingham et al.
D318,699 S 7/1991 Jacobson et al.
5,029,801 A 7/1991 Dalebout et al.
5,034,576 A 7/1991 Dalebout et al.
5,058,881 A 10/1991 Measom
5,058,882 A 10/1991 Dalebout et al.
D321,388 S 11/1991 Dalebout
5,062,626 A 11/1991 Dalebout et al.
5,062,627 A 11/1991 Bingham
5,062,632 A 11/1991 Dalebout et al.
5,062,633 A 11/1991 Engel et al.
5,067,710 A 11/1991 Watterson et al.
5,072,929 A 12/1991 Peterson et al.
D323,009 S 1/1992 Dalebout et al.
D323,198 S 1/1992 Dalebout et al.
D323,199 S 1/1992 Dalebout et al.
D323,863 S 2/1992 Watterson
5,088,729 A 2/1992 Dalebout
5,090,694 A 2/1992 Pauls et al.
5,102,380 A 4/1992 Jacobson et al.
5,104,120 A 4/1992 Watterson et al.
5,108,093 A 4/1992 Watterson
D326,491 S 5/1992 Dalebout
5,122,105 A 6/1992 Engel et al.
5,135,216 A 8/1992 Bingham et al.
5,147,265 A 9/1992 Pauls et al.
5,149,084 A 9/1992 Dalebout et al.
5,149,312 A 9/1992 Croft et al.
5,171,196 A 12/1992 Lynch
D332,347 S 1/1993 Raadt et al.
5,190,505 A 3/1993 Dalebout et al.
5,192,255 A 3/1993 Dalebout et al.
5,195,937 A 3/1993 Engel et al.
5,203,826 A 4/1993 Dalebout
D335,511 S 5/1993 Engel et al.
D335,905 S 5/1993 Cutter et al.
D336,498 S 6/1993 Engel et al.
5,217,487 A 6/1993 Engel et al.
D337,361 S 7/1993 Engel et al.
D337,666 S 7/1993 Peterson et al.
D337,799 S 7/1993 Cutter et al.
5,226,866 A 7/1993 Engel et al.
5,244,446 A 9/1993 Engel et al.
5,247,853 A 9/1993 Dalebout
5,259,611 A 11/1993 Dalebout et al.
D342,106 S 12/1993 Campbell et al.
5,279,528 A 1/1994 Dalebout et al.
D344,112 S 2/1994 Smith
D344,557 S 2/1994 Ashby
5,282,776 A 2/1994 Dalebout
5,295,931 A 3/1994 Dreibelbis et al.
5,302,161 A 4/1994 Loubert et al.
D347,251 S 5/1994 Dreibelbis et al.
5,316,534 A 5/1994 Dalebout et al.
D348,493 S 7/1994 Ashby
D348,494 S 7/1994 Ashby
5,328,164 A 7/1994 Soga
D349,931 S 8/1994 Bostic et al.
5,336,142 A 8/1994 Dalebout et al.
5,344,376 A 9/1994 Bostic et al.
D351,202 S 10/1994 Bingham
D351,435 S 10/1994 Peterson et al.
D351,633 S 10/1994 Bingham
D352,534 S 11/1994 Dreibelbis et al.
D353,422 S 12/1994 Bostic et al.
5,372,559 A 12/1994 Dalebout et al.
5,374,228 A 12/1994 Buisman et al.
5,382,221 A 1/1995 Hsu et al.
5,387,168 A 2/1995 Bostic
5,393,690 A 2/1995 Fu et al.
D356,128 S 3/1995 Smith et al.
5,409,435 A 4/1995 Daniels
5,429,563 A 7/1995 Engel et al.
5,431,612 A 7/1995 Holden
D360,915 S 8/1995 Bostic et al.
5,468,205 A 11/1995 McFall et al.
5,489,249 A 2/1996 Brewer et al.
5,492,517 A 2/1996 Bostic et al.
D367,689 S 3/1996 Wilkinson et al.
5,511,740 A 4/1996 Loubert et al.
5,512,025 A 4/1996 Dalebout et al.
D370,949 S 6/1996 Furner
D371,176 S 6/1996 Furner
5,527,245 A 6/1996 Dalebout et al.
5,529,553 A 6/1996 Finlayson
5,540,429 A 7/1996 Dalebout et al.
5,549,533 A 8/1996 Olson et al.
5,554,085 A 9/1996 Dalebout
5,569,128 A 10/1996 Dalebout
5,591,105 A 1/1997 Dalebout et al.
5,591,106 A 1/1997 Dalebout et al.
5,595,556 A 1/1997 Dalebout et al.
5,607,375 A 3/1997 Dalebout et al.
5,611,539 A 3/1997 Watterson et al.
5,622,527 A 4/1997 Watterson et al.
5,626,538 A 5/1997 Dalebout et al.
5,626,542 A 5/1997 Dalebout et al.
D380,024 S 6/1997 Novak et al.
5,637,059 A 6/1997 Dalebout
D380,509 S 7/1997 Wilkinson et al.
5,643,153 A 7/1997 Nylen et al.
5,645,509 A 7/1997 Brewer et al.
D384,118 S 9/1997 Deblauw
5,662,557 A 9/1997 Watterson et al.
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,331 A 11/1997 Dalebout
5,683,332 A 11/1997 Watterson et al.
D387,825 S 12/1997 Fleck et al.
5,695,433 A 12/1997 Buisman
5,695,434 A 12/1997 Dalebout et al.
5,695,435 A 12/1997 Dalebout et al.
5,702,325 A 12/1997 Watterson et al.
5,704,879 A 1/1998 Watterson et al.
5,718,657 A 2/1998 Dalebout et al.
5,720,200 A 2/1998 Anderson et al.
5,720,698 A 2/1998 Dalebout et al.
D392,006 S 3/1998 Dalebout et al.
5,722,922 A 3/1998 Watterson et al.

(56) References Cited

U.S. PATENT DOCUMENTS 5,733,229 A 3/1998 Dalebout et al.
5,743,833 A 4/1998 Watterson et al.
5,762,584 A 6/1998 Daniels
5,762,587 A 6/1998 Dalebout et al.
5,772,560 A 6/1998 Watterson et al.
5,810,698 A 9/1998 Hullett et al.
5,827,155 A 10/1998 Jensen et al.
5,830,114 A 11/1998 Halfen et al.
5,860,893 A 1/1999 Watterson et al.
5,860,894 A 1/1999 Dalebout et al.
5,899,834 A 5/1999 Dalebout et al.
D412,953 S 8/1999 Armstrong
D413,948 S 9/1999 Dalebout
5,951,441 A 9/1999 Dalebout et al.
5,951,448 A 9/1999 Bolland
D416,596 S 11/1999 Armstrong
6,003,166 A 12/1999 Hald et al.
6,019,710 A 2/2000 Dalebout et al.
6,027,429 A 2/2000 Daniels
6,033,347 A 3/2000 Dalebout et al.
D425,940 S 5/2000 Halfen et al.
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout et al.
6,193,631 B1 2/2001 Hickman
6,228,003 B1 5/2001 Hald et al.
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout et al.
6,312,363 B1 11/2001 Watterson et al.
D452,338 S 12/2001 Dalebout et al.
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris et al.
6,422,980 B1 7/2002 Simonson
6,447,424 B1 9/2002 Ashby et al.
6,458,060 B1 10/2002 Watterson et al.
6,458,061 B2 10/2002 Simonson
6,471,622 B1 10/2002 Hammer et al.
6,563,225 B2 5/2003 Soga et al.
6,601,016 B1 7/2003 Brown et al.
6,623,140 B2 9/2003 Watterson et al.
6,626,799 B2 9/2003 Watterson et al.
6,652,424 B2 11/2003 Dalebout
6,685,607 B1 2/2004 Olson
6,695,581 B2 2/2004 Wasson et al.
6,701,271 B2 3/2004 Willner et al.
6,702,719 B1 3/2004 Brown et al.
6,712,740 B2 3/2004 Simonson
6,730,002 B2 5/2004 Hald et al.
6,743,153 B2 6/2004 Watterson et al.
6,746,371 B1 6/2004 Brown et al.
6,749,537 B1 6/2004 Hickman
6,761,667 B1 7/2004 Cutler et al.
6,770,015 B2 8/2004 Simonson
6,786,852 B2 9/2004 Watterson et al.
6,808,472 B1 10/2004 Hickman
6,821,230 B2 11/2004 Dalebout et al.
6,830,540 B2 12/2004 Watterson et al.
6,863,641 B1 3/2005 Brown et al.
6,866,613 B1 3/2005 Brown et al.
6,875,160 B2 4/2005 Watterson et al.
D507,311 S 7/2005 Butler et al.
6,918,858 B2 7/2005 Watterson et al.
6,921,351 B1 7/2005 Hickman et al.
6,974,404 B1 12/2005 Watterson et al.
6,997,852 B2 2/2006 Watterson et al.
7,025,713 B2 4/2006 Dalebout et al.
D520,085 S 5/2006 Willardson et al.
7,044,897 B2 5/2006 Myers et al.
7,052,442 B2 5/2006 Watterson et al.
7,060,006 B1 6/2006 Watterson et al.
7,060,008 B2 6/2006 Watterson et al.
7,070,539 B2 7/2006 Brown et al.
7,097,588 B2 8/2006 Watterson et al.
D527,776 S 9/2006 Willardson et al.
7,112,168 B2 9/2006 Dalebout et al.
7,128,693 B2 10/2006 Brown et al.
7,166,062 B1 1/2007 Watterson et al.
7,166,064 B2 1/2007 Watterson et al.
7,169,087 B2 1/2007 Ercanbrack et al.
7,169,093 B2 1/2007 Simonson et al.
7,192,388 B2 3/2007 Dalebout et al.
7,250,022 B2 7/2007 Dalebout et al.
7,282,016 B2 10/2007 Simonson
7,285,075 B2 10/2007 Cutler et al.
7,344,481 B2 3/2008 Watterson et al.
7,377,882 B2 5/2008 Watterson et al.
7,425,188 B2 9/2008 Ercanbrack et al.
7,429,236 B2 9/2008 Dalebout et al.
7,455,622 B2 11/2008 Watterson et al.
7,482,050 B2 1/2009 Olson
D588,655 S 3/2009 Utykanski
7,510,509 B2 3/2009 Hickman
7,537,546 B2 5/2009 Watterson et al.
7,537,549 B2 5/2009 Nelson et al.
7,537,552 B2 5/2009 Dalebout et al.
7,540,828 B2 6/2009 Watterson et al.
7,549,947 B2 6/2009 Hickman et al.
7,556,590 B2 7/2009 Watterson et al.
7,563,203 B2 7/2009 Dalebout et al.
7,575,536 B1 8/2009 Hickman
7,601,105 B1 10/2009 Gipson et al.
7,604,573 B2 10/2009 Dalebout et al.
D604,373 S 11/2009 Dalebout et al.
7,618,350 B2 11/2009 Dalebout et al.
7,618,357 B2 11/2009 Dalebout et al.
7,625,315 B2 12/2009 Hickman
7,625,321 B2 12/2009 Simonson et al.
7,628,730 B1 12/2009 Watterson et al.
7,628,737 B2 12/2009 Kowallis et al.
7,637,847 B1 12/2009 Hickman
7,645,212 B2 1/2010 Ashby et al.
7,645,213 B2 1/2010 Watterson et al.
7,658,698 B2 2/2010 Pacheco et al.
7,674,205 B2 3/2010 Dalebout et al.
7,713,171 B1 5/2010 Hickman
7,713,172 B2 5/2010 Watterson et al.
7,713,180 B2 5/2010 Wickens et al.
7,717,828 B2 5/2010 Simonson et al.
7,736,279 B2 6/2010 Dalebout et al.
7,740,563 B2 6/2010 Dalebout et al.
7,749,144 B2 7/2010 Hammer
7,766,797 B2 8/2010 Dalebout et al.
7,771,329 B2 8/2010 Dalebout et al.
7,775,940 B2 8/2010 Dalebout et al.
7,789,800 B1 9/2010 Watterson et al.
7,798,946 B2 9/2010 Dalebout et al.
7,815,550 B2 10/2010 Watterson et al.
7,857,731 B2 12/2010 Hickman et al.
7,862,475 B2 1/2011 Watterson et al.
7,862,478 B2 1/2011 Watterson et al.
7,862,483 B2 1/2011 Hendrickson et al.
D635,207 S 3/2011 Dalebout et al.
7,901,330 B2 3/2011 Dalebout et al.
7,909,740 B2 3/2011 Dalebout et al.
7,980,996 B2 7/2011 Hickman
7,981,000 B2 7/2011 Watterson et al.
7,985,164 B2 7/2011 Ashby
8,029,415 B2 10/2011 Ashby et al.
8,033,960 B1 10/2011 Dalebout et al.
D650,451 S 12/2011 Olson et al.
D652,877 S 1/2012 Dalebout et al.
8,152,702 B2 4/2012 Pacheco
D659,775 S 5/2012 Olson et al.
D659,777 S 5/2012 Watterson et al.

(56) References Cited

U.S. PATENT DOCUMENTS

D660,383 S 5/2012 Watterson et al.
D664,613 S 7/2012 Dalebout et al.
8,251,874 B2 8/2012 Ashby et al.
8,298,123 B2 10/2012 Hickman
8,298,125 B2 10/2012 Colledge et al.
D671,177 S 11/2012 Sip
D671,178 S 11/2012 Sip
D673,626 S 1/2013 Olson et al.
8,690,735 B2 4/2014 Watterson et al.
D707,763 S 6/2014 Cutler
8,740,753 B2 6/2014 Olson et al.
8,758,201 B2 6/2014 Ashby et al.
8,771,153 B2 7/2014 Dalebout et al.
8,784,270 B2 7/2014 Ashby et al.
8,808,148 B2 8/2014 Watterson et al.
8,814,762 B2 8/2014 Butler et al.
D712,493 S 9/2014 Ercanbrack et al.
8,840,075 B2 9/2014 Dalebout et al.
8,845,493 B2 9/2014 Watterson et al.
8,870,726 B2 10/2014 Watterson et al.
8,876,668 B2 11/2014 Hendrickson et al.
8,894,549 B2 11/2014 Colledge
8,894,555 B2 11/2014 Colledge et al.
8,911,330 B2 12/2014 Watterson et al.
8,920,288 B2 12/2014 Dalebout et al.
8,986,165 B2 3/2015 Ashby
8,992,364 B2 3/2015 Law et al.
8,992,387 B2 3/2015 Watterson et al.
D726,476 S 4/2015 Ercanbrack
9,028,368 B2 5/2015 Ashby et al.
9,028,370 B2 5/2015 Watterson et al.
9,039,578 B2 5/2015 Dalebout
D731,011 S 6/2015 Buchanan
9,072,930 B2 7/2015 Ashby et al.
9,119,983 B2 9/2015 Rhea
9,123,317 B2 9/2015 Watterson et al.
9,126,071 B2 9/2015 Smith
9,126,072 B2 9/2015 Watterson
9,138,615 B2 * 9/2015 Olson ..... A63B 22/0023
9,142,139 B2 9/2015 Watterson et al.
9,144,703 B2 9/2015 Dalebout et al.
9,149,683 B2 10/2015 Watterson et al.
9,186,535 B2 11/2015 Ercanbrack
9,186,549 B2 11/2015 Watterson et al.
9,254,409 B2 2/2016 Dalebout et al.
9,254,416 B2 2/2016 Ashby
9,278,248 B2 3/2016 Tyger et al.
9,278,249 B2 3/2016 Watterson
9,278,250 B2 3/2016 Buchanan
9,289,648 B2 3/2016 Watterson
9,339,691 B2 5/2016 Brammer
9,352,185 B2 5/2016 Hendrickson et al.
9,352,186 B2 5/2016 Watterson
9,375,605 B2 6/2016 Tyger et al.
9,381,394 B2 7/2016 Mortensen et al.
9,387,387 B2 7/2016 Dalebout
9,393,453 B2 7/2016 Watterson
9,403,047 B2 8/2016 Olson et al.
9,403,051 B2 8/2016 Cutler
9,421,416 B2 8/2016 Mortensen et al.
9,457,219 B2 10/2016 Smith
9,457,220 B2 10/2016 Olson
9,457,222 B2 10/2016 Dalebout
9,460,632 B2 10/2016 Watterson
9,463,356 B2 10/2016 Rhea
9,468,794 B2 10/2016 Barton
9,468,798 B2 10/2016 Dalebout
9,480,874 B2 11/2016 Cutler
9,492,704 B2 11/2016 Mortensen et al.
9,498,668 B2 11/2016 Smith
9,517,378 B2 12/2016 Ashby et al.
9,521,901 B2 12/2016 Dalebout
9,533,187 B2 1/2017 Dalebout
9,539,461 B2 1/2017 Ercanbrack
9,579,544 B2 2/2017 Watterson
9,586,086 B2 3/2017 Dalebout et al.
9,586,090 B2 3/2017 Watterson et al.
9,604,099 B2 3/2017 Taylor
9,616,276 B2 4/2017 Dalebout et al.
9,616,278 B2 4/2017 Olson
9,623,281 B2 4/2017 Hendrickson et al.
9,636,567 B2 5/2017 Brammer et al.
9,675,839 B2 6/2017 Dalebout et al.
9,682,307 B2 6/2017 Dalebout
9,694,234 B2 7/2017 Dalebout et al.
9,694,242 B2 7/2017 Ashby et al.
9,737,755 B2 8/2017 Dalebout
9,757,605 B2 9/2017 Olson et al.
9,764,186 B2 9/2017 Dalebout et al.
9,767,785 B2 9/2017 Ashby et al.
9,795,822 B2 10/2017 Smith et al.
9,808,672 B2 11/2017 Dalebout
9,849,326 B2 12/2017 Smith
9,878,210 B2 1/2018 Watterson
9,889,334 B2 2/2018 Ashby et al.
9,889,339 B2 2/2018 Douglass
9,937,376 B2 4/2018 McInelly et al.
9,937,377 B2 4/2018 McInelly et al.
9,937,378 B2 4/2018 Dalebout et al.
9,937,379 B2 4/2018 Mortensen et al.
9,943,719 B2 4/2018 Smith et al.
9,943,722 B2 4/2018 Dalebout
9,948,037 B2 4/2018 Ashby
9,968,816 B2 5/2018 Olson et al.
9,968,821 B2 5/2018 Finlayson et al.
9,968,823 B2 5/2018 Cutler
10,010,755 B2 7/2018 Watterson
10,010,756 B2 7/2018 Watterson
10,029,145 B2 7/2018 Douglass
D826,350 S 8/2018 Hochstrasser
10,046,196 B2 8/2018 Ercanbrack et al.
D827,733 S 9/2018 Hochstrasser
10,065,064 B2 9/2018 Smith et al.
10,071,285 B2 9/2018 Smith et al.
10,085,586 B2 10/2018 Smith et al.
10,086,254 B2 10/2018 Watterson
10,136,842 B2 11/2018 Ashby
10,186,161 B2 1/2019 Watterson
10,188,890 B2 1/2019 Olson et al.
10,207,143 B2 2/2019 Dalebout et al.
10,207,145 B2 2/2019 Tyger et al.
10,207,147 B2 2/2019 Ercanbrack et al.
10,207,148 B2 2/2019 Powell et al.
10,212,994 B2 2/2019 Watterson et al.
10,220,259 B2 3/2019 Brammer
10,226,396 B2 3/2019 Ashby
10,226,664 B2 3/2019 Dalebout et al.
10,252,109 B2 4/2019 Watterson
10,258,828 B2 4/2019 Dalebout et al.
10,272,317 B2 4/2019 Watterson
10,279,212 B2 5/2019 Dalebout et al.
10,293,211 B2 5/2019 Watterson et al.
D852,292 S 6/2019 Cutler
10,343,017 B2 7/2019 Jackson
10,376,736 B2 8/2019 Powell et al.
10,388,183 B2 8/2019 Watterson
10,391,361 B2 8/2019 Watterson
D864,320 S 10/2019 Weston
D864,321 S 10/2019 Weston
10,426,989 B2 10/2019 Dalebout
10,433,612 B2 10/2019 Ashby et al.
10,441,840 B2 10/2019 Dalebout
10,441,844 B2 10/2019 Powell
10,449,416 B2 10/2019 Dalebout et al.
10,471,299 B2 11/2019 Powell
D868,909 S 12/2019 Cutler et al.
10,492,519 B2 12/2019 Capell et al.
10,493,349 B2 12/2019 Watterson
10,500,473 B2 12/2019 Watterson
10,537,764 B2 1/2020 Smith et al.
10,543,395 B2 1/2020 Powell et al.
10,561,877 B2 2/2020 Workman
10,561,893 B2 2/2020 Chatterton et al.
10,561,894 B2 2/2020 Dalebout et al.

(56) References Cited

U.S. PATENT DOCUMENTS

| | | | | |
|---|---|---|---|---|
| 10,569,121 | B2 | 2/2020 | Watterson | |
| 10,569,123 | B2 | 2/2020 | Hochstrasser et al. | |
| 10,625,114 | B2 | 4/2020 | Ercanbrack | |
| 10,625,137 | B2 | 4/2020 | Dalebout et al. | |
| 10,661,114 | B2 | 5/2020 | Watterson et al. | |
| 10,668,320 | B2 | 6/2020 | Watterson | |
| 10,671,705 | B2 | 6/2020 | Capell et al. | |
| 10,688,346 | B2 | 6/2020 | Brammer | |
| 10,702,736 | B2 | 7/2020 | Weston et al. | |
| 10,709,925 | B2 | 7/2020 | Dalebout et al. | |
| 10,726,730 | B2 | 7/2020 | Watterson | |
| 10,729,965 | B2 | 8/2020 | Powell | |
| 10,758,767 | B2 | 9/2020 | Olson et al. | |
| 10,786,706 | B2 | 9/2020 | Smith | |
| 10,864,407 | B2 | 12/2020 | Watterson et al. | |
| 10,918,905 | B2 | 2/2021 | Powell et al. | |
| 10,932,517 | B2 | 3/2021 | Ashby et al. | |
| 10,940,360 | B2 | 3/2021 | Dalebout et al. | |
| 10,953,268 | B1 | 3/2021 | Dalebout et al. | |
| 10,953,305 | B2 | 3/2021 | Dalebout et al. | |
| 10,967,214 | B1 | 4/2021 | Olson et al. | |
| 10,994,173 | B2 | 5/2021 | Watterson | |
| 11,000,730 | B2 | 5/2021 | Dalebout et al. | |
| 11,013,960 | B2 | 5/2021 | Watterson et al. | |
| 11,033,777 | B1 | 6/2021 | Watterson et al. | |
| 11,058,913 | B2 | 7/2021 | Dalebout et al. | |
| 11,058,914 | B2 | 7/2021 | Powell | |
| 11,058,918 | B1 | 7/2021 | Watterson et al. | |
| 11,187,285 | B2 | 11/2021 | Wrobel | |
| 11,298,577 | B2 | 4/2022 | Watterson | |
| 11,326,673 | B2 | 5/2022 | Buchanan | |
| 11,338,169 | B2 | 5/2022 | Dalebout et al. | |
| 11,338,175 | B2 | 5/2022 | Watterson et al. | |
| 11,426,633 | B2 | 8/2022 | Watterson et al. | |
| 11,451,108 | B2 | 9/2022 | Tinney | |
| 11,452,903 | B2 | 9/2022 | Watterson | |
| 11,511,152 | B2 | 11/2022 | Powell et al. | |
| 11,534,651 | B2 | 12/2022 | Ercanbrack et al. | |
| 11,534,654 | B2 | 12/2022 | Silcock et al. | |
| 11,534,655 | B2 | 12/2022 | Dalebout et al. | |
| 11,565,148 | B2 | 1/2023 | Dalebout et al. | |
| 11,596,830 | B2 | 3/2023 | Dalebout et al. | |
| 11,642,564 | B2 | 5/2023 | Watterson | |
| 11,673,036 | B2 | 6/2023 | Dalebout et al. | |
| 11,680,611 | B2 | 6/2023 | Wrobel | |
| 11,700,905 | B2 | 7/2023 | Ashby et al. | |
| 11,708,874 | B2 | 7/2023 | Wrobel | |
| 2008/0051256 | A1 | 2/2008 | Ashby et al. | |
| 2015/0251055 | A1 | 9/2015 | Ashby | |
| 2015/0335941 | A1* | 11/2015 | Lo | A63B 22/0015 482/54 |
| 2016/0058335 | A1 | 3/2016 | Ashby | |
| 2016/0346595 | A1 | 12/2016 | Dalebout et al. | |
| 2017/0124912 | A1 | 5/2017 | Ashby et al. | |
| 2017/0193578 | A1 | 7/2017 | Watterson | |
| 2017/0266489 | A1 | 9/2017 | Douglass et al. | |
| 2017/0270820 | A1 | 9/2017 | Ashby et al. | |
| 2018/0085630 | A1 | 3/2018 | Capell et al. | |
| 2018/0099116 | A1 | 4/2018 | Ashby | |
| 2018/0099180 | A1 | 4/2018 | Wilkinson | |
| 2018/0099205 | A1* | 4/2018 | Watterson | A63B 71/0619 |
| 2018/0111034 | A1 | 4/2018 | Watterson | |
| 2019/0192898 | A1* | 6/2019 | Dalebout | A63B 22/0605 |
| 2019/0223612 | A1 | 7/2019 | Watterson et al. | |
| 2019/0269971 | A1 | 9/2019 | Capell et al. | |
| 2020/0009417 | A1 | 1/2020 | Dalebout | |
| 2020/0368575 | A1 | 11/2020 | Hays et al. | |
| 2020/0391069 | A1 | 12/2020 | Olson et al. | |
| 2021/0001177 | A1 | 1/2021 | Smith | |
| 2021/0046353 | A1* | 2/2021 | Dalebout | A63B 22/0023 |
| 2021/0106899 | A1 | 4/2021 | Willardson et al. | |
| 2021/0110910 | A1 | 4/2021 | Ostler et al. | |
| 2021/0146221 | A1 | 5/2021 | Dalebout et al. | |
| 2021/0213331 | A1 | 7/2021 | Watterson | |
| 2021/0268336 | A1 | 9/2021 | Watterson et al. | |
| 2021/0291013 | A1 | 9/2021 | Nascimento | |
| 2021/0299518 | A1 | 9/2021 | Brammer et al. | |
| 2021/0299542 | A1 | 9/2021 | Brammer et al. | |
| 2021/0339079 | A1 | 11/2021 | Dalebout et al. | |
| 2022/0062685 | A1 | 3/2022 | Ashby et al. | |
| 2022/0104992 | A1 | 4/2022 | Ashby | |
| 2022/0212052 | A1 | 7/2022 | Ercanbrack et al. | |
| 2022/0241649 | A1 | 8/2022 | Ashby | |
| 2022/0241665 | A1 | 8/2022 | Dalebout et al. | |
| 2022/0241668 | A1 | 8/2022 | Willardson et al. | |
| 2022/0249912 | A1 | 8/2022 | Watterson et al. | |
| 2022/0257994 | A1 | 8/2022 | Smith | |
| 2022/0258007 | A1 | 8/2022 | Watterson et al. | |
| 2022/0258008 | A1 | 8/2022 | Watterson et al. | |
| 2022/0266085 | A1 | 8/2022 | Dalebout et al. | |
| 2022/0280857 | A1 | 9/2022 | Watterson | |
| 2022/0296959 | A1* | 9/2022 | Li | A63B 22/001 |
| 2022/0309042 | A1 | 9/2022 | Archer | |
| 2022/0314078 | A1 | 10/2022 | Watterson et al. | |
| 2022/0323827 | A1 | 10/2022 | Watterson et al. | |
| 2022/0339493 | A1 | 10/2022 | Larsen | |
| 2022/0339520 | A1 | 10/2022 | Toth | |
| 2022/0342969 | A1 | 10/2022 | Watterson et al. | |
| 2022/0347516 | A1 | 11/2022 | Taylor | |
| 2022/0347548 | A1 | 11/2022 | Watterson | |
| 2022/0362613 | A1 | 11/2022 | Watterson et al. | |
| 2022/0362624 | A1 | 11/2022 | Dalebout | |
| 2022/0395729 | A1 | 12/2022 | Toth | |
| 2023/0039903 | A1 | 2/2023 | Brammer et al. | |
| 2023/0054845 | A1 | 2/2023 | Smith | |
| 2023/0122235 | A1 | 4/2023 | Ashby et al. | |
| 2023/0128721 | A1 | 4/2023 | Plummer | |
| 2023/0158358 | A1 | 5/2023 | Ercanbrack et al. | |
| 2023/0181993 | A1 | 6/2023 | Taylor et al. | |
| 2023/0191189 | A1 | 6/2023 | Taylor et al. | |
| 2023/0191197 | A1 | 6/2023 | Ashby | |
| 2023/0218975 | A1 | 7/2023 | Toles et al. | |
| 2023/0226401 | A1 | 7/2023 | Watterson | |

OTHER PUBLICATIONS

U.S. Appl. No. 17/739,819, filed May 9, 2022, Buchanan.
U.S. Appl. No. 17/841,313, filed Jun. 15, 2022, Weston et al.
U.S. Appl. No. 17/963,822, filed Oct. 11, 2022, Powell.
U.S. Appl. No. 18/091,004, filed Dec. 29, 2022, Cox.
U.S. Appl. No. 18/103,221, filed Jan. 30, 2023, Dalebout et al.
U.S. Appl. No. 18/114,758, filed Feb. 27, 2023, Cutler et al.
U.S. Appl. No. 18/117,263, filed Mar. 3, 2023, Smith et al.
U.S. Appl. No. 18/123,026, filed Mar. 17, 2023, Silcock et al.
U.S. Appl. No. 18/132,277, filed Apr. 7, 2023, Vasquez et al.
U.S. Appl. No. 18/136,535, filed Apr. 19, 2023, Ashby et al.
U.S. Appl. No. 18/141,872, filed May 1, 2023, Ashby et al.
U.S. Appl. No. 18/205,299, filed Jun. 2, 2023, Wrobel.
U.S. Appl. No. 18/207,512, filed Jun. 8, 2023, Chuang.
U.S. Appl. No. 18/210,505, filed Jun. 15, 2023, Nielsen et al.
U.S. Appl. No. 29/702,127, filed Sep. 16, 2019, Cutler et al.
U.S. Appl. No. 62/273,852, filed Dec. 31, 2015, Watterson.
U.S. Appl. No. 63/073,081, filed Sep. 1, 2021, Ashby et al.
U.S. Appl. No. 63/079,697, filed Sep. 7, 2020, Willardson et al.
U.S. Appl. No. 63/086,793, filed Oct. 20, 2020, Ashby.
U.S. Appl. No. 63/134,036, filed Jan. 5, 2021, Ercanbrack et al.
U.S. Appl. No. 63/150,066, filed Feb. 16, 2021, Smith.
U.S. Appl. No. 63/156,801, filed Mar. 4, 2021, Watterson.
U.S. Appl. No. 63/165,498, filed Mar. 24, 2021, Archer.
U.S. Appl. No. 63/179,094, filed Apr. 23, 2021, Watterson et al.
U.S. Appl. No. 63/180,521, filed Apr. 27, 2021, Watterson et al.
U.S. Appl. No. 63/187,348, filed May 11, 2021, Dalebout et al.
U.S. Appl. No. 63/188,431, filed May 13, 2021, Plummer.
U.S. Appl. No. 63/200,903, filed Apr. 2, 2021, Watterson et al.
U.S. Appl. No. 63/211,870, filed Jun. 17, 2021, Watterson et al.
U.S. Appl. No. 63/216,313, filed Jun. 29, 2021, Watterson et al.
U.S. Appl. No. 63/229,794, filed Aug. 12, 2021, Brammer.
U.S. Appl. No. 63/235,002, filed Aug. 19, 2021, Smith.
U.S. Appl. No. 63/254,470, filed Oct. 11, 2021, Powell.
U.S. Appl. No. 63/278,714, filed Nov. 12, 2021, Taylor.

(56) References Cited

OTHER PUBLICATIONS

U.S. Appl. No. 63/289,997, filed Dec. 15, 2021, Taylor et al.
U.S. Appl. No. 63/290,455, filed Dec. 16, 2021, Taylor et al.
U.S. Appl. No. 63/290,557, filed Dec. 16, 2021, Ashby.
U.S. Appl. No. 63/298,170, filed Jan. 10, 2022, Ercanbrack et al.
U.S. Appl. No. 63/299,357, filed Jan. 13, 2022, Toles et al.
U.S. Appl. No. 63/305,976, filed Feb. 2, 2022, Watterson.
U.S. Appl. No. 63/329,270, filed Apr. 8, 2022, Vasquez et al.
U.S. Appl. No. 63/332,581, filed Apr. 25, 2022, Ashby et al.
U.S. Appl. No. 63/338,265, filed May 4, 2022, Ashby et al.
U.S. Appl. No. 63/350,072, filed Jun. 8, 2022, Chuang.
U.S. Appl. No. 63/352,539, filed Jun. 15, 2022, Nielsen et al.
U.S. Appl. No. 63/471,680, filed Jun. 7, 2023, Powell et al.

* cited by examiner

LIFT MECHANISM FOR AN EXERCISE DEVICE

CROSS-REFERENCE TO RELATED APPLICATIONS

This application claims priority to and the benefit of U.S. Patent Provisional Application No. 63/290,455, filed Dec. 16, 2021, which is hereby incorporated by reference in its entirety.

BACKGROUND

Exercise is popular activity that many people perform to improve their physical and/or mental health. Exercise devices are often utilized to allow a person to exercise a variety of muscles in a variety of activities. Some exercise devices increase difficulty by changing the settings on an exercise device. In some situations, an exercise device may adjust an incline angle of the exercise deck to increase the difficulty of the exercise.

BRIEF SUMMARY

In some embodiments, an exercise device includes an upright structure having a lower portion and an upper portion. An exercise deck has a front end and a rear end. The front end of the exercise deck is movable along the upright structure between the lower portion and the upper portion. A console is connected to the upright structure at the top end. An incline mechanism is located in the upright structure. The incline mechanism is connected to the front end of the exercise deck and the upper portion of the upright structure. In some embodiments, the exercise device is a treadmill. In some embodiments, the incline mechanism includes a lift motor and a threaded rod coupled to the lift motor. A lift trolley is connected to the front end of the exercise deck and slidably connected to the upright structure. A lift coupler is threaded to the threaded rod and connected to the lift trolley.

In some embodiments, a method for changing an incline angle of an exercise deck includes rotating a threaded rod with a lift motor. The lift motor is located above the exercise deck. The threaded rod extends through and upright structure to a front end of the exercise deck. The threaded rod is inserted into a threaded coupler connected to a lift trolley. In some embodiments, a vertical position of the threaded coupler is changed along the threaded rod based on the rotation of the threaded rod. In some embodiments, the incline angle of the exercise deck is adjusted based on the vertical position of the threaded coupler.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which:

FIG. 2-1 is a representation of a rear view of a treadmill showing an incline mechanism in the neutral position, according to at least one embodiment of the present disclosure;

FIG. 2-2 is a rear view of the treadmill of FIG. 2-1 in an incline position;

FIG. 2-3 is a side view of the treadmill of FIG. 2-1 in the neutral position;

FIG. 2-4 is a side view of the treadmill of FIG. 2-1 in the incline position;

FIG. 2-5 is a side view of the treadmill of FIG. 2-1 in the decline position;

FIG. 3 is a representation of the lower portion of an incline mechanism, according to at least one embodiment of the present disclosure;

FIG. 4 is a representation of an upper portion of an incline mechanism, according to at least one embodiment of the present disclosure;

FIG. 5 is a flowchart of a method for adjusting the incline angle of an exercise device, according to at least one embodiment of the present disclosure;

DETAILED DESCRIPTION

This disclosure generally relates to devices, systems, and methods for adjusting the incline angle of an exercise deck of an exercise device, such as a treadmill. An incline mechanism may be located in an upright structure of the treadmill. The incline mechanism may include a threaded rod connected to a threaded coupler on a lift trolley. The lift trolley is connected to the exercise deck. A lift motor in the upright structure may rotate the threaded rod within the threaded coupler. This may change the location of the threaded coupler to change along the length of the threaded rod, thereby changing a height of the lift trolley. As the height of the lift trolley changes, the incline angle of the exercise deck may change.

In accordance with one or more embodiments of the present disclosure, the threaded rod may be placed in tension while adjusting the incline angle of the lift mechanism. This may help to increase the maximum incline angle of the exercise deck. In some embodiments, the threaded rod may be anchored to an upper portion of the upright structure above the exercise deck. The threaded rod may support the weight of the front end of the exercise deck, and transfer the weight to the upper portion of the upright structure. This may place the threaded rod in tension and allow for an increased height that the front end of the exercise deck may be lifted.

In accordance with one or more embodiments of the present disclosure, the lift motor for the incline mechanism may be located above the front end of the exercise deck. For example, in some embodiments, the lift motor may be located in the upright structure. In some examples, the lift motor may be located in the console. This may help to reduce the "step-height" of the exercise device, or the profile of the exercise device above the ground surface.

Figure 1:
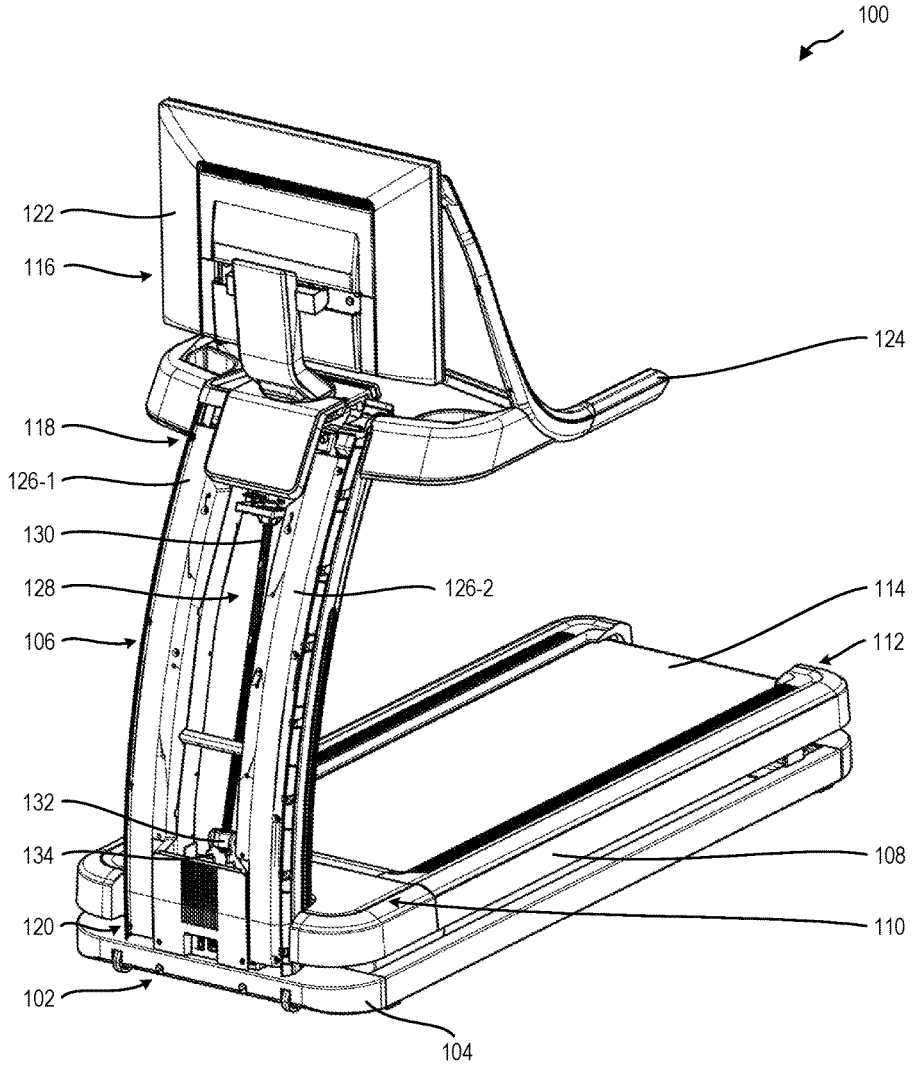
FIG. 1 is a representation of an exercise device, according to at least one embodiment of the present disclosure.

FIG. 1 is a representation of a treadmill 100, according to at least one embodiment of the present disclosure. The treadmill 100 includes a frame 102. The frame 102 includes a base 104 and an upright structure 106. An exercise deck 108 includes a front pulley located at a front end 110 of the exercise deck 108 and a rear pulley located at a rear end 112 of the exercise deck 108. A tread belt 114 extends between the front pulley and the rear pulley. A drive motor may be connected to one or both of the front pulley or the rear pulley. The drive motor may rotate the front pulley and/or the rear pully. Friction between the front pulley and the drive pulley and the tread belt 114 may cause the tread belt 114 to rotate when the drive motor rotates the pulleys. The speed of the drive motor may thus be related to the speed of the tread belt 114. A user may walk or run forwards (e.g., while facing a console 116) when the tread belt 114 rotates in a forward direction from the front end 110 to the rear end 112 of the exercise deck 108. A user may walk or run backwards (e.g., while facing the console 116) when the tread belt 114 rotates in a backward direction from the rear end 112 to the front end 110.

While embodiments of the present disclosure may be described with reference to a treadmill, it should be understood that this disclosure may be utilized with any exercise device. For example, an elliptical device has an exercise deck with an adjustable inclination, and the lift mechanisms described herein may be utilized on an elliptical device. In some examples, a stationary bicycle may have a lift mechanism to adjust the incline angle of the stationary bicycle. In some examples, the lift mechanism and other principles described herein may be applicable to any other exercise device.

The console 116 may be supported by the upright structure 106. Put another way, the console 116 may rest on an upper portion 118 of the upright structure 106. The upright structure 106 may be connected to the base 104 at a lower portion 120 of the upright structure 106. The console 116 includes a display 122. In some embodiments, one or more handles 124 is be connected to the console 116 and/or the upper portion 118 of the upright structure 106. In some embodiments, the handles 124 are part of the console 116. In some embodiments, the handles 124 are part of the frame 102 connected to the upright structure 106.

In the embodiment shown, the upright structure 106 includes a first post 126-1 and a second post 126-2. Both the first post 126-1 and the second post 126-2 may be connected to the base 104 and support the console 116. In some embodiments, the first post 126-1 and the second post 126-2 are load-bearing or support at least a portion of the weight of the console 116 and/or the handles 124. In some embodiments, as discussed in further detail herein, the first post 126-1 and/or the second post 126-2 support at least a portion of the weight of the exercise deck 108. For example, the front end 110 of the exercise deck may be suspended from the upper portion 118 of the upright structure 106, or the upper portion 118 of both of the first post 126-1 and/or the second post. This may help to support the stability of the exercise deck 108 during an exercise activity.

The treadmill 100 includes a lift mechanism 128. In accordance with embodiments of the present disclosure, the lift mechanism 128 may be at least partially located within the upright structure 106. In some embodiments, the lift mechanism 128 is entirely or wholly located or contained within the upright structure 106. In some embodiments, the lift mechanism 128 is at least partially located within the console 116.

The lift mechanism 128 may include a threaded rod 130 connected to a lift coupler 132. In some embodiments, the threaded rod 130 is connected to the upright structure 106. In some embodiments, the threaded rod 130 is at least partially located within the upright structure 106. In some embodiments, the threaded rod 130 is entirely located within the upright structure 106. In some embodiments, the threaded rod 130 is at least partially located within the console 116. In the embodiment shown, the threaded rod 130 is located between the first post 126-1 and the second post 126-2. In some embodiments, the threaded rod 130 is located within the first post 126-1 or the second post 126-2. In some embodiments, the upright structure 106 includes a single post, and the threaded rod 130 is located within the single post.

In some embodiments, the threaded rod 130 is supported by the upright structure 106. For example, the threaded rod 130 may be connected to the upright structure 106 such that the threaded rod 130 transfers some or all forces applied to it to the upright structure 106. In some embodiments, the threaded rod 130 is connected to the upper portion 118 of the upright structure 106. In this manner, the threaded rod 130 may be suspended from the upright structure 106. In some embodiments, the threaded rod 130 is connected to the upright structure 106 above the front end 110 of the exercise deck 108. In some embodiments, the threaded rod 130 is connected to the upright structure 106 at any location between the upper portion 118 and the lower portion 120. In some embodiments, the threaded rod 130 is connected to the upright structure 106 below the front end 110 of the exercise deck 108.

The lift coupler 132 may be connected to a lift trolley 134, and the lift trolley 134 may be connected to the front end 110 of the exercise deck 108. The lift coupler 132 may include internal threads that are complementary to the threads on the threaded rod 130. The lift coupler 132 may be rotationally fixed relative to the threaded rod 130. Put another way, the threaded rod 130 may rotate within the lift coupler 132. To change the inclination of the exercise deck 108, a lift motor may rotate the threaded rod 130. The threaded rod 130 may rotate within the lift coupler 132. The threaded connection between the threaded rod 130 and the lift coupler 132 may cause the lift coupler 132 to move along the length of the threaded rod 130. Moving the lift coupler 132 may change the vertical position of the lift trolley 134. Changing the vertical position of the lift trolley 134 may change the vertical position of the front end 110 of the exercise deck 108, thereby changing an incline angle of the exercise deck 108. Because the lift coupler 132 is connected to the lift trolley 134, and the lift trolley 134 is connected to front end 110 of the exercise deck 108, as rotating the threaded rod 130 may result in a change in inclination of the exercise deck 108.

In some embodiments, the lift motor is located at least partially within the upright structure 106. In some embodiments, the lift motor is located at least partially within the console 116. In some embodiments, the console 116 includes one or more computing devices. The computing devices may include one or more exercise programs. An exercise program includes a series of exercise activities that a user may perform. During an exercise activity, the console 116 may direct the tread belt 114 to be rotated at a particular speed. The speed may be associated with a walking or running pace for the user. In some embodiments, the console directs the front end 110 to be elevated to a particular incline angle during an exercise activity. For example, actuation of the lift motor may be controlled by one or more computing devices in the console. In some embodiments, the computing devices is controlled by one or more input devices on the console 116, such as a button, a switch, a toggle, a touch-sensitive screen, any other input device, and combinations thereof. In some embodiments, actuation of the lift motor may be controlled by one or more input devices on any other portion of the treadmill 100, such as the upright structure 106 or the handles 124. In some embodiments, actuation of the lift mechanism 128 is controlled by a remote computing device, such as a mobile device, a cloud server, a network server, any other computing device, and combinations thereof. In some embodiments, the console is positioned to allow simultaneous user interaction with the console while performing an exercise activity.

Figures 1, 2:
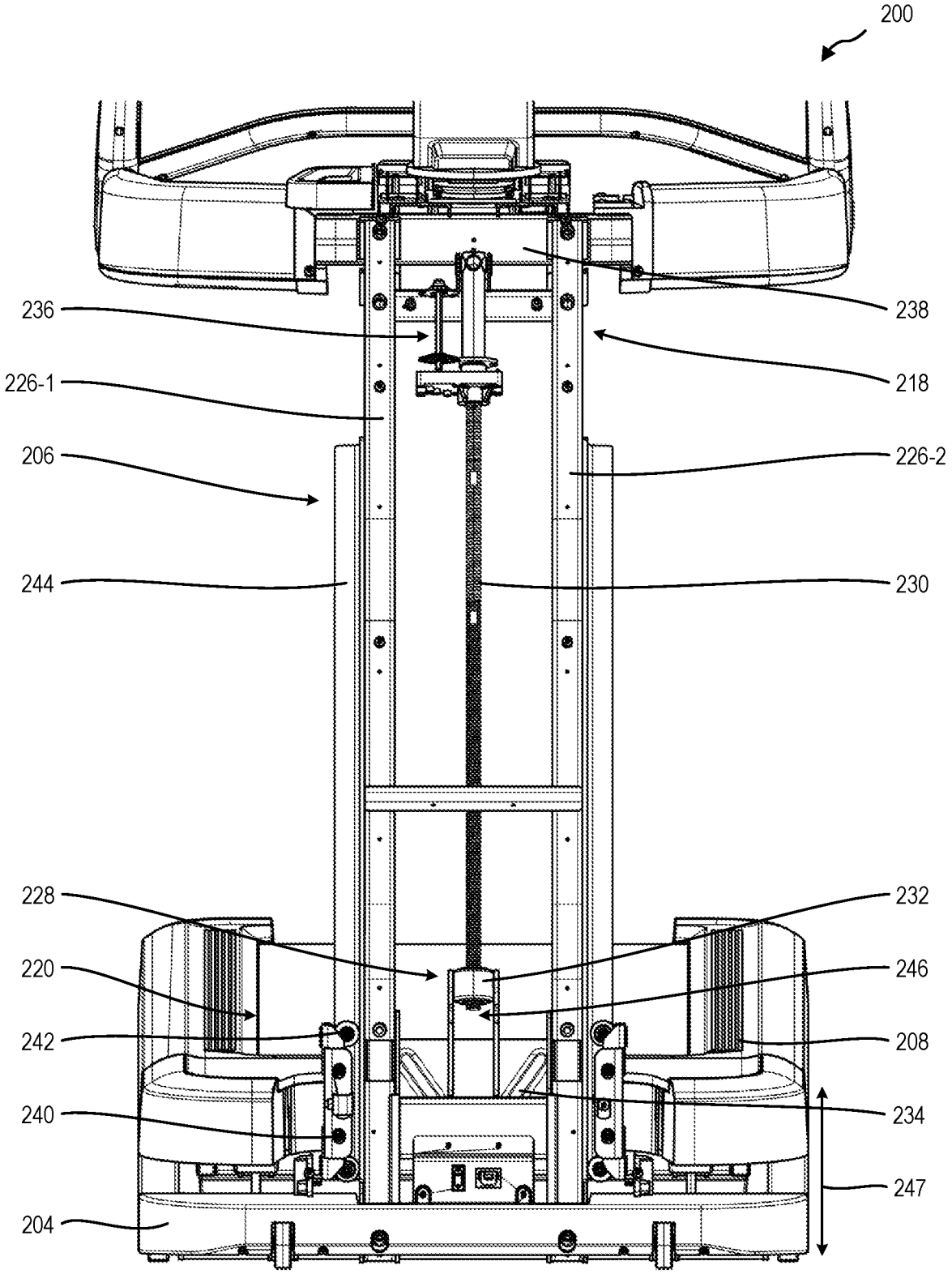
Figure 2:
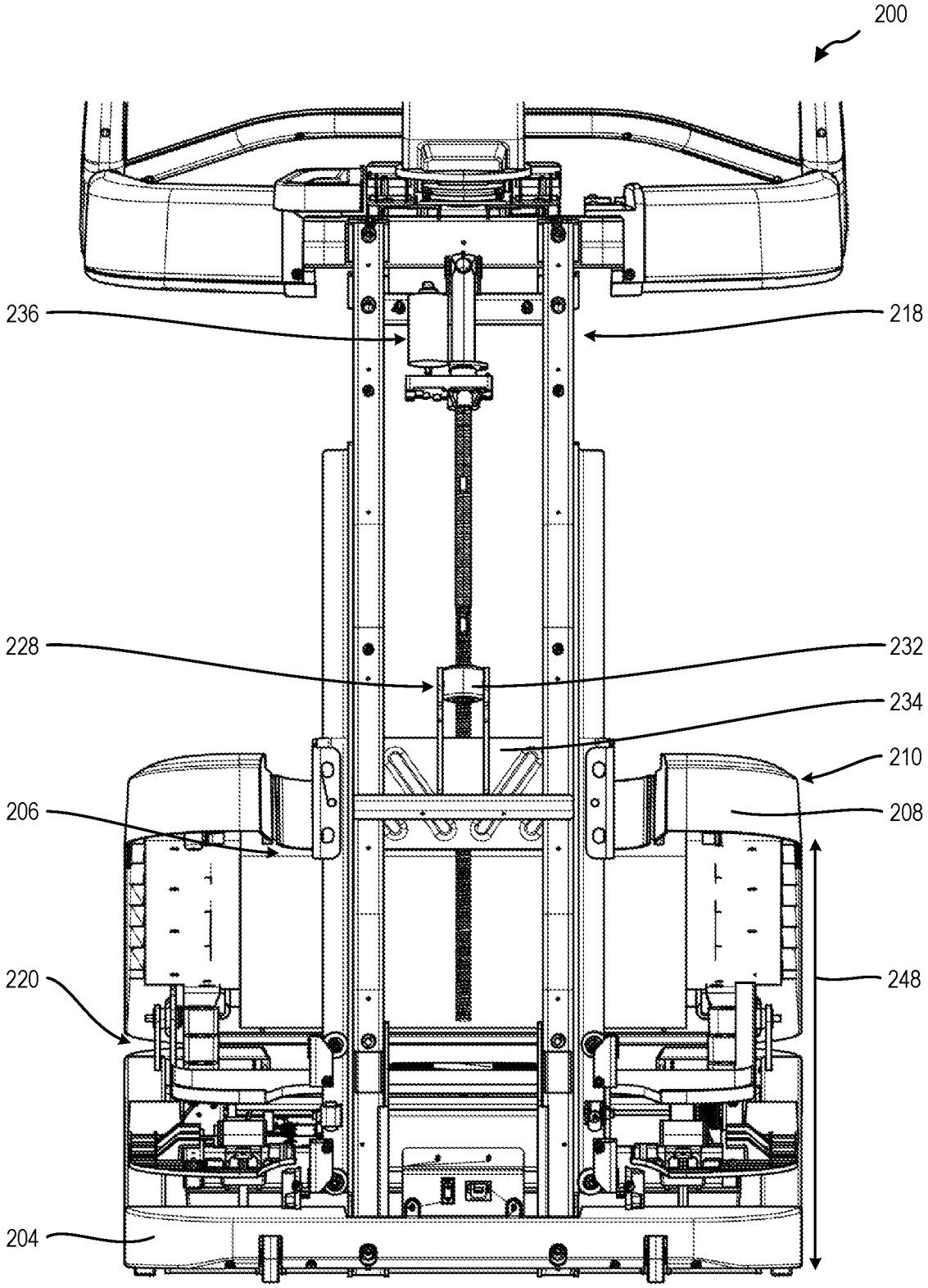

FIG. 2-1 is a representation of a front-end view of a treadmill 200 in a neutral position, according to at least one embodiment of the present disclosure. In the neutral position, the incline angle of the exercise deck 208 is approximately or about 0° (e.g., the incline angle is approximately level). As discussed herein, the treadmill 200 includes a lift mechanism 228. The lift mechanism 228 may be located in the upright structure 206. In the embodiment shown, the lift mechanism 228 is located between a first post 226-1 and a second post 226-2 of the upright structure 206.

The lift mechanism 228 includes a lift motor 236 coupled to a threaded rod 230. The lift motor 236 may be configured to rotate the threaded rod 230, which may cause a change in an incline angle of an exercise deck 208, as discussed herein. In accordance with one or more embodiments of the present disclosure, threaded rod 230 extends from the upper portion 218 of the upright support to the exercise deck 208. In some embodiments, the threaded rod is secured to an upper portion 218 of the upright structure 206. In some embodiments, the lift motor 236 is secured to the upper portion 218 of the upright structure 206. In some embodiments, a lift mount 238 is secured to the upper portion 218 of the upright structure 206. The lift motor 236 and/or the threaded rod 230 is secured to the lift mount 238. In the embodiment shown, the lift mount 238 extends between the first post 226-1 and the second post 226-2. The lift motor 236 and/or the threaded rod 230 may be secured to a center of the lift mount 238, thereby distributing any transferred load to the first post 226-1 and the second post 226-2.

In the embodiment shown, the lift motor 236 and the threaded rod 230 are secured to the upright structure 206 above the exercise deck 208. This may place the threaded rod 230 in tension as the threaded rod 230 takes on the weight of the exercise deck 208. Placing the threaded rod 230 in tension may increase the stability of the lift mechanism 228. For example, a lift mechanism 228 that is under compression may experience buckling, bending, flexure, or other movement especially as the length of the rod, piston, or other lift element increases to increase the incline angle. Placing the threaded rod 230 in tension may reduce the buckling, bending, flexure, or other movement. This may help to improve the stability, and indeed the stiffness, of the exercise deck 208 during operation. In some embodiments, placing the lift motor 236 and the threaded rod 230 above the exercise deck 208 increases the maximum incline angle of the exercise deck 208 by increasing the stiffness of the lift mechanism 228.

In some embodiments, placing the lift motor 236 and the threaded rod 230 above the exercise deck 208 at the front end of the exercise deck 208 increases the maximum incline angle of the exercise deck by allowing the angle between the exercise deck 208 and the threaded rod 230 to remain close to 90°. In this manner, the load transferred to the threaded rod 230 may be parallel or close to parallel to the length or the rotational axis of the threaded rod 230. This may further help to reduce buckling, bending, flexure, or other movement in the threaded rod 230, and therefore the stability of the exercise deck 208 during operation. This increased stability of the threaded rod 230 may alloy for a higher maximum incline angle of the exercise deck 208.

Conventionally, the lift mechanism 228 is located below the exercise deck 208. By placing the lift mechanism 228 above the exercise deck 208, a step height 247 of the exercise deck 208 may be decreased. The step height 247 may be the height from a ground surface (e.g., the surface upon which the base 204 rests) to the upper surface of the exercise deck 208. Reducing the step height 247 may help to reduce the tripping hazard of the treadmill 200 as the user mounts and dismounts the treadmill during use. In some embodiments, the minimum step height 247 is in a range having an upper value, a lower value, or upper and lower values including any of 18 in. (45.7 cm), 20 in. (50.8 cm), 22 in. (55.9 cm), 24 in. (61.0 cm), 26 in. (66.0 cm), 28 in. (71.1 cm), 30 in. (76.2 cm), or any value therebetween. For example, the minimum step height 247 may be greater than 18 in. (45.7 cm). In another example, the minimum step height 247 may be less than 30 in. (76.2 cm). In yet other examples, the minimum step height 247 may be any value in a range between 18 in. (45.7 cm) and 30 in. (76.2 cm). In some embodiments, it may be critical that the minimum step height 247 is less than or equal to 24 in. (61.0 cm) to reduce the tripping hazard of a user mounting and/or dismounting the treadmill 200.

The threaded rod 230 may be connected to a lift trolley 234 with a lift coupler 232. The lift coupler 232 may include internal threads that are complementary to the threaded rod 230. As the lift motor 236 rotates the threaded rod 230, the threaded rod 230 may rotate within the lift coupler 232. The interaction of the threaded connection between the threaded rod 230 and the lift coupler 232 may cause the lift coupler 232 to change position along the length of the threaded rod 230. For example, if the threaded rod 230 is rotated in a first direction, then lift coupler 232 may move up the threaded rod 230 (e.g., toward the upper portion 218 of the upright structure 206. If the threaded rod 230 is rotated in a second direction, then the lift coupler 232 may move down the threaded rod 230 (e.g., toward a lower portion 220 of the upright structure 206).

Because the lift coupler 232 is connected to the lift trolley 234, when the lift coupler 232 moves along the length of the threaded rod 230, then the lift trolley 234 may change a vertical position. The lift trolley 234 is connected to the front end of the exercise deck 208. Thus, as the lift trolley 234 changes vertical position, the front end of the exercise deck 208 may change vertical position. Changing the position of the front end of the exercise deck 208 may change the incline angle of the exercise deck 208. Thus, the incline angle of the exercise deck 208 may be changed by rotating the threaded rod 230 with the lift motor 236.

The lift trolley 234 may include one or more stabilizers 240. The stabilizers 240 may include one or more wheels 242 that engage with the upright structure 206. In some embodiments, the stabilizers 240, and in particular the wheels 242, stabilize the lateral position of the exercise deck 208 relative to the upright structure 206. As the lift trolley 234 changes vertical position, the stabilizers 240 and the wheels 242 may engage the upright structure to maintain the lateral position of the exercise deck. In some embodiments, the lift trolley 234 includes two stabilizers 240 that engage with either side of the upright structure 206. In some embodiments, the upright structure 206 includes one or more guide tracks 244. In some embodiments, the front end 210 of the exercise deck 208 is slidably coupled to the one or more guide tracks 244. For example, the stabilizers 240 may be slidably coupled to the one or more guide tracks 244. The guide tracks 244 may help to guide the stabilizers 240 and/or the wheels 242 and maintain the position of the lift trolley 234.

In some embodiments, a bottom 246 of the threaded rod 230 is free-floating. For example, the bottom 246 of the threaded rod 230 may not be connected to any structure of the treadmill 200, including the base 204, the upright structure 206, the lift trolley 234, the exercise deck 208, any other structure of the treadmill 200, and combinations thereof. This may allow the bottom 246 freedom of movement as the vertical position of the lift coupler 232 changes.

In the embodiment shown, the threaded rod 230 extends between the first post 226-1 and the second post 226-2. However, it should be understood that the threaded rod 230 may be located in any position. For example, the threaded rod 230 may be inserted into a post of the upright structure. In some embodiments, the lift mechanism 228 includes two or more threaded rods 230. For example, the lift mechanism 228 may include two threaded rods. This may reduce the load on each rod, thereby allowing for a smaller threaded rod. In some embodiments, the two threaded rods extends through the posts of the upright structure 206.

FIG. 2-2 is a representation of the treadmill 200 of FIG. 2-1 in an inclined position. To move from the neutral position of FIG. 2-1 to the inclined position of FIG. 2-2, the lift motor 236 may rotate the threaded rod 230. As the threaded rod 230 rotates, the lift coupler 232 may travel up the threaded rod 230 (e.g., toward the upper portion 218 of the upright structure 206). This may cause the connected lift trolley 234 to move upwards, thereby lifting the front end 210 of the exercise deck 208 upward. In the inclined position shown, the front end 210 of the exercise deck 208 is raised above the base 204 with a front end height 248. The rear end 212 of the exercise deck 208 may remain connected to the base 204. In this manner, as the front end height 248 increases, the incline angle of the exercise deck 208 may be increased.

In some embodiments, the maximum front end height 248 is in a range having an upper value, a lower value, or upper and lower values including any of 36 in. (91.4 cm), 38 in. (96.5 cm), 40 in. (1.02 m), 42 in. (1.07 m), 44 in. (1.12 m), 46 in. (1.17 m), 48 in. (1.22 m), 50 in. (1.27 m), 52 in. (1.32 m), 54 in. (1.37 m), or any value therebetween. For example, the maximum front end height 248 may be greater than 36 in. (91.4 cm). In another example, the maximum front end height 248 may be less than 54 in. (1.37 m). In yet other examples, the maximum front end height 248 may be any value in a range between 36 in. (91.4 cm) and 54 in. (1.37 m). In some embodiments, it is critical that the maximum front end height 248 is greater than or equal to 48 in. (1.22 m) to increase the available incline angles for the user. The maximum front end height 248 may be increased over conventional systems because of the placement of the lift mechanism 228 above the exercise deck 208.

Figures 2, 3:
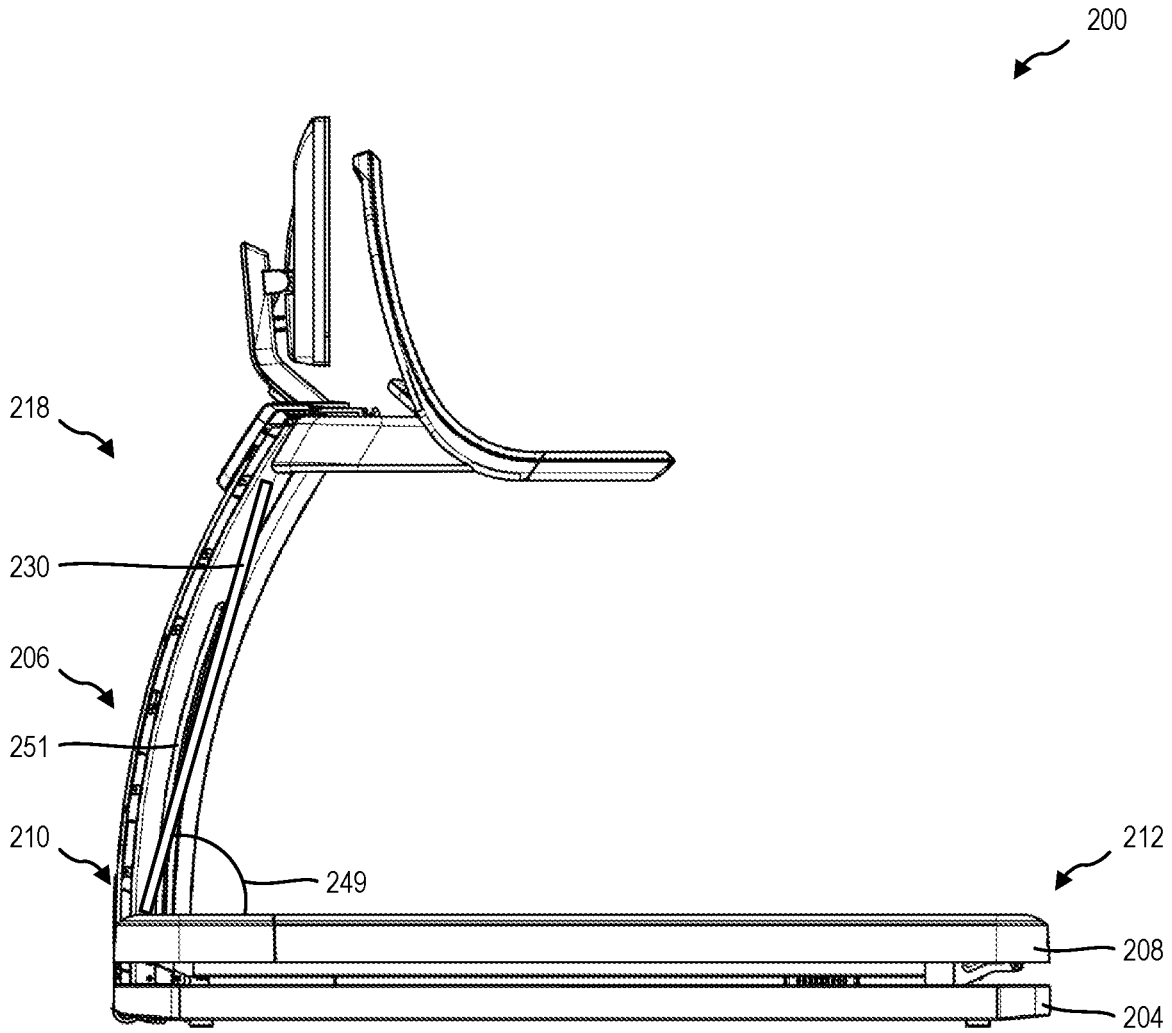

FIG. 2-3 is a side view of the treadmill 200 of FIG. 2-1 in the neutral position. For ease of illustration, a threaded rod 230 is superimposed over the upright structure 206. The threaded rod 230 may be connected to the upright structure 206 at an upper end of the upright structure 206 with a pivot connection. The threaded rod 230 may be connected to the front end 210 of the exercise deck 208 with a pivot connection. As may be seen, the threaded rod 230 and the exercise deck 208 may form a rod angle 249.

As the front end 210 of the exercise deck 208 is lifted upward, the rear end 212 of the exercise deck 208 may remain connected to the base 204. This may cause the front end 210 to follow a curved path upward. The upright structure 206 may include a guide 251 that follows the curved path. By connecting the threaded rod 230 to the upright structure 206 and the front end of the exercise deck 208 with pivot connections, the threaded rod 430 may remain connected to both the upright structure 206 and the exercise deck 208. Furthermore, the rod angle 249 may change and the height of the front end 210 may change.

Figures 2, 3, 4:
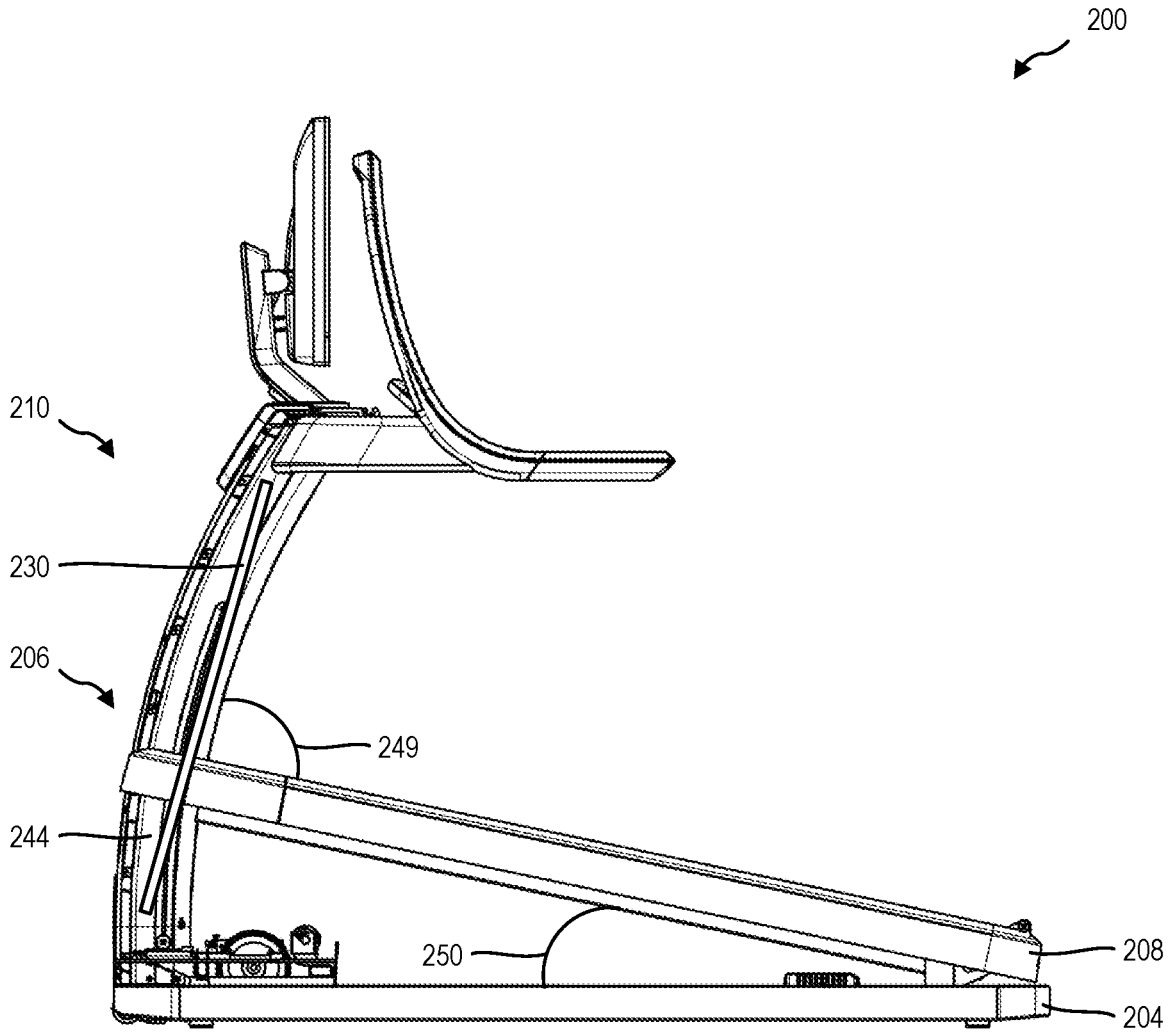

FIG. 2-4 is a side view of the treadmill 200 of FIG. 2-1 in the incline position shown in FIG. 2-2. In the incline position, the exercise deck 208 forms an incline angle 250 with the base 204. In some embodiments, the maximum incline angle 250 is in a range having an upper value, a lower value, or upper and lower values including any of 30°, 32°, 34°, 36°, 38°, 40°, 42°, 44°, 45°, 50°, 55°, or any value therebetween. For example, the maximum incline angle 250 may be greater than 30°. In another example, the maximum incline angle 250 may be less than 55°. In yet other examples, the maximum incline angle 250 may be any value in a range between 30° and 55°. In some embodiments, it is be critical that the maximum incline angle 250 is greater than or equal to 45° to increase the available incline angles for the user.

As discussed herein, in the incline position shown in FIG. 2-4, the rod angle 249 may be different than shown in FIG. 2-3. In some embodiments, the rod angle 249 is in a range having an upper value, a lower value, or upper and lower values including any of 60°, 65°, 70°, 75°, 80°, 85°, 90°, 95°, 100°, or any value therebetween. For example, the rod angle 249 may be greater than 60°. In another example, the rod angle 249 may be less than 100°. In yet other examples, the rod angle 249 may be any value in a range between 60° and 100°. In some embodiments, it is critical that the rod angle 249 is between 70° and 90° to increase the stability of the treadmill by orienting the supporting force of the threaded rod 230 in line with the length of the threaded rod 230.

In some embodiments, a rod angle change is the change in rod angle 249 between the neutral position shown in FIG. 2-3 and the incline position shown in FIG. 2-4. In some embodiments, the rod angle change is in a range having an upper value, a lower value, or upper and lower values including any of 1°, 2°, 4°, 6°, 8°, 10°, 12°, 14°, 15°, or any value therebetween. For example, the rod angle change may be greater than 1°. In another example, the rod angle change may be less than 15°. In yet other examples, the rod angle change may be any value in a range between 1° and 15°. In some embodiments, it is critical that the rod angle change is less than 10° to improve the stability of the treadmill 200 by orienting the supporting force of the threaded rod 230 in line with the length of the threaded rod 230.

In accordance with one or more embodiments of the present disclosure, the exercise deck 208 is secured at any position or incline angle between the neutral position shown in FIG. 2-3 to the maximum incline angle. Put another way, the exercise deck 208 may be secured with the front end 210 of the exercise deck at any height above the base 204. This may allow the user to perform exercise activities at any incline angle or front end height. In some embodiments, the front end 210 of the exercise deck 208 is supported by the threaded rod 230 while the user is performing an exercise activity. Put another way, the lift mechanism 228 may support the weight of the user transferred through the front end 210 of the exercise deck 208. In this manner, the incline angle may be fluidly adjustable in any position between the neutral position and the incline position.

In some embodiments, the upright structure 206 and/or the guide track 244 includes one or more locking positions between the neutral position and the incline position. In the locking position, a mechanical interlock may secure the front end 210 of the exercise deck 208 to the upright structure 206. This may help to directly transfer the weight of the user and the front end 210 to the upright structure 206 without placing additional strain on the lift mechanism 228. In some embodiments, the mechanical interlock includes any type of mechanical interlock. For example, the mechanical interlock may include a pin and socket. A pin may be inserted into a socket, thereby supporting the front end of the exercise device. In some embodiments, the pin is located on the front end 210 of the exercise deck 208 or the lift trolley 234 and the socket may be located on the upright structure 206 (e.g., one or both of the first post 226-1 or the second post 226-2). In some embodiments, the pin is located on the upright structure 206 (e.g., one or both of the first post 226-1 or the second post 226-2) and the socket may be located on the front end 210 of the exercise deck 208 or the lift trolley 234. In some embodiments, any mechanical interlock is used to create a locking position. In some embodiments, the locking position is positioned at regular intervals, such as every 1°, 1.5°, 2°, 2.5°, 3°, 3.5°, 4°, 4.5°, 5°, or any value therebetween.

FIG. 2-5 is a representation of the treadmill 200 of FIG. 2-1 in a decline position where the rear end 212 is raised higher than the front end 210. In the embodiment shown, a rear incline mechanism 253 has lifted the rear end 212 of the exercise deck 208. The front end 210 of the exercise deck 208 is located at the lower portion 220 of the upright structure 206. This may allow for a negative incline angle 250, or a decline angle. In some embodiments, the maximum decline angle is in a range having an upper value, a lower value, or upper and lower values including any of 5°, 10°, 15°, 20°, 25°, 30°, or any value therebetween. For example, the maximum decline angle may be greater than 5°. In another example, the maximum decline angle may be less than 30°. In yet other examples, the maximum decline angle may be any value in a range between 5° and 30°. In some embodiments, it is critical that the maximum decline angle is greater than 15° to improve the exercise experience for the user.

FIG. 3 is a representation of a lower portion of a lift mechanism 328 in the neutral or lowered position, according to at least one embodiment of the present disclosure. The view shown is captured from the perspective of the exercise deck looking toward the upright structure 306. In the view shown, the lift coupler 332 is threaded to the bottom of the threaded rod 330. The lift coupler 332 is connected to a lift trolley 334.

In some embodiments, the lift coupler 332 is connected to the lift trolley 334 with a lift coupler bracket 352. In some embodiments, the lift coupler bracket 352 is connected to the lift trolley with a weld, braze, a mechanical fastener, any other connection, or combinations thereof. In some embodiments, the lift coupler 332 is connected to the lift coupler bracket 352 with a pivoting connection 354. The pivoting connection 354 may secure the lift coupler 332 so that the lift coupler 332 does not rotate relative to the lift trolley 334 and allow the threaded rod 330 to rotate with thin the lift coupler 332. In some embodiments, the pivoting connection allows the lift coupler 332 to rotate with the threaded rod 330 as the orientation of the threaded rod 330 changes with the height of the lift trolley 334.

FIG. 4 is a representation of an upper portion of a lift mechanism 428, according to at least one embodiment of the present disclosure. A lift motor 436 may be connected to the upper portion 418 of an upright structure 406. The upright structure 406 may include a first post 426-1 and a second post 426-2. A lift mount 438 may be connected to and extend between the first post 426-1 and the second post 426-2. The lift motor 436 and a threaded rod 430 may be connected to the lift mount 438. The lift mount 438, and through the lift mount 438 the first post 426-1 and the second post 426-2, may support the weight and any connected loads (such as the exercise deck) of the threaded rod 430.

In the embodiment shown, the lift motor 436 is connected to the threaded rod 430 with a geared connection 456. However, it should be understood that the lift motor 436 may be connected to the threaded rod 430 with any other type of connection. In some embodiments, the lift motor 436 is directly connected to the threaded rod 430. In some embodiments, the threaded rod 430 is connected to the lift mount 438 with a rod connector 458. In some embodiments, the rod connector 458 is connected to the lift mount 438 with a rod pivot 460. The rod pivot 460 may allow the rod connector 458 and the connected threaded rod 430 to pivot as the height of the exercise deck changes. In some embodiments, the rod connector 458 is connected to the threaded rod 430 with a rotating connection. In some embodiments, the rod connector 458 includes a bearing, such as a thrust bearing.

In some embodiments, the rod connector 458 includes a motor support 462. The motor support 462 may be include a platform upon which the lift motor 436 rests. The motor support 462 may pivot with the rod connector 458 as the height of the exercise deck changes. In this manner, the lift motor 436 may pivot as the height of the exercise deck changes. In some embodiments, the lift motor 436 is directly connected to the lift mount 438 with its own pivot connection.

Figures 2, 3, 4, 5:
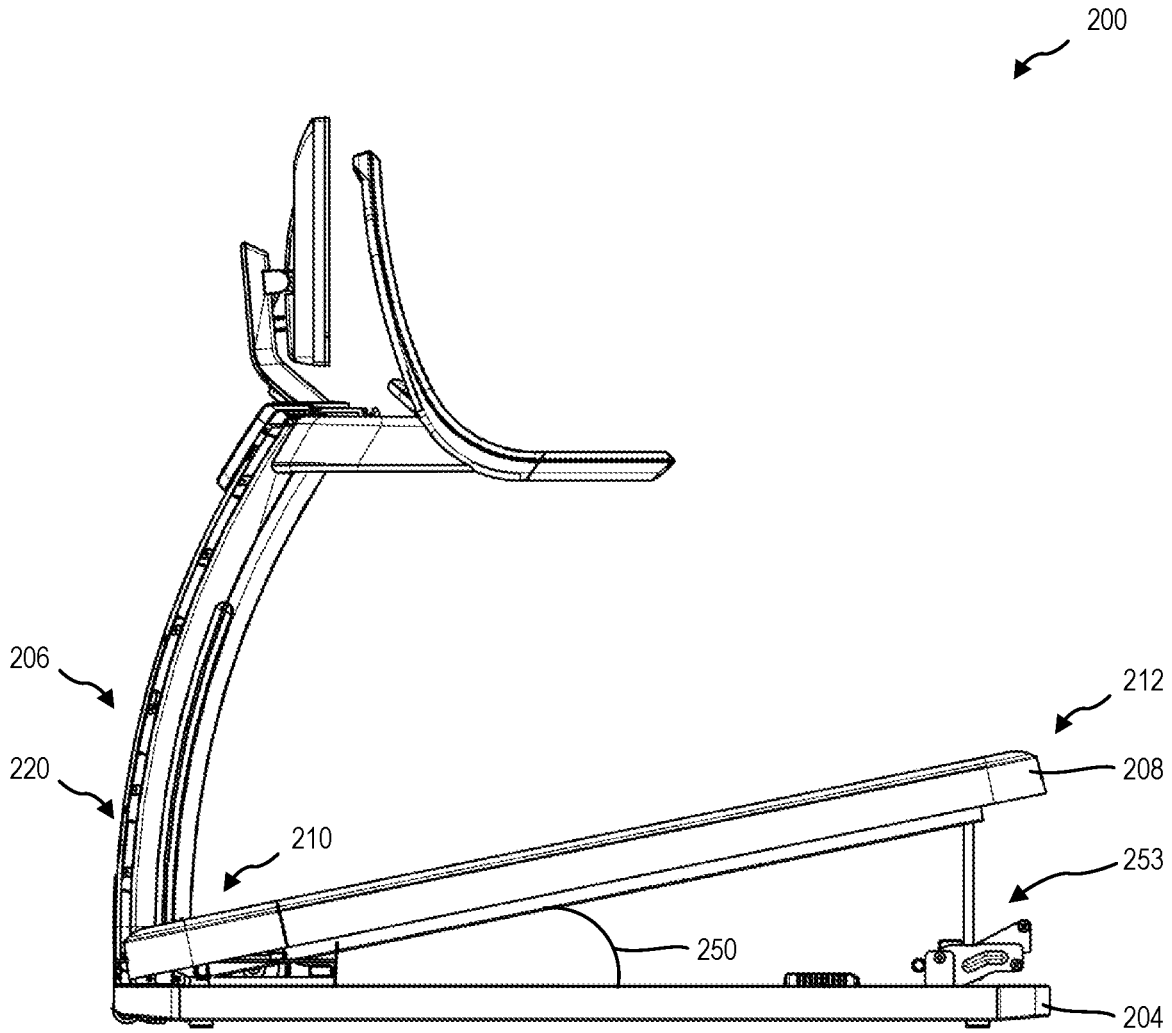
Figure 3:
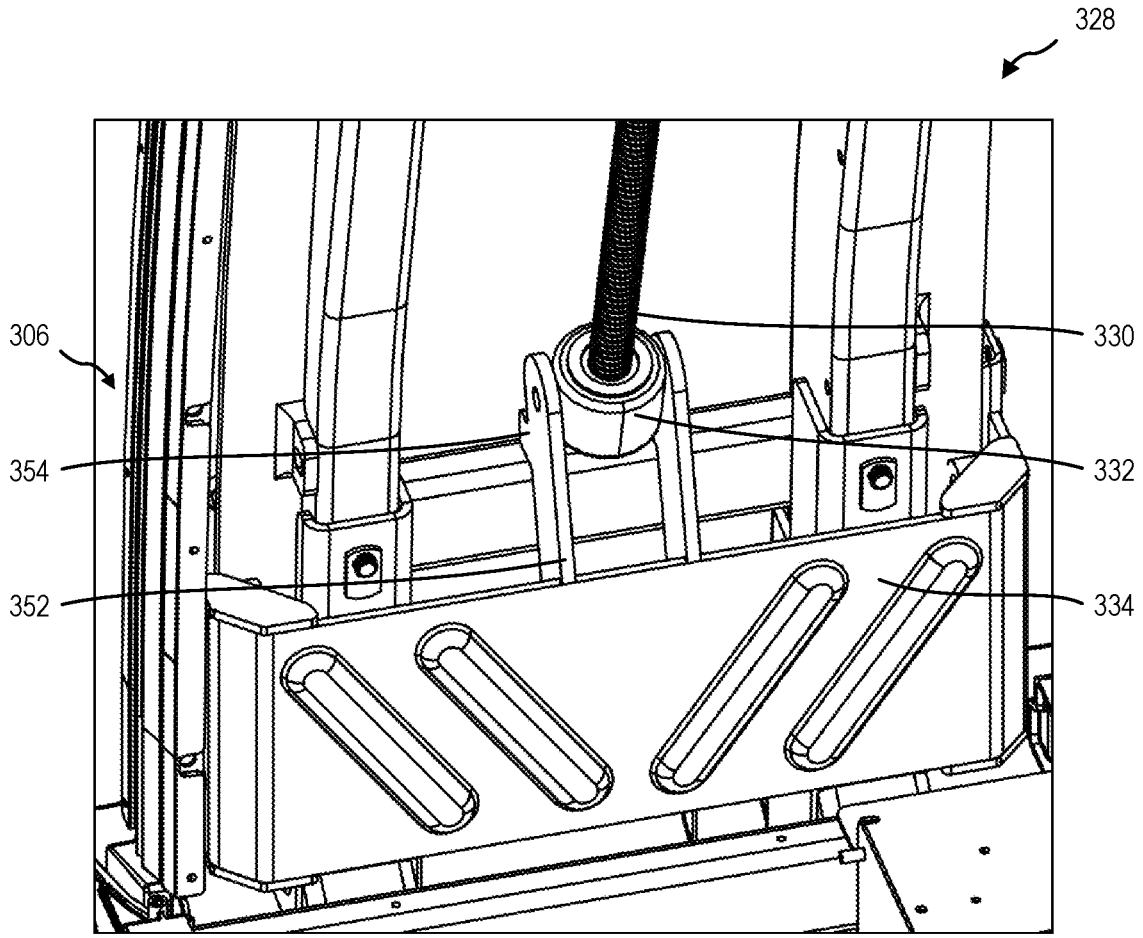
Figure 4:
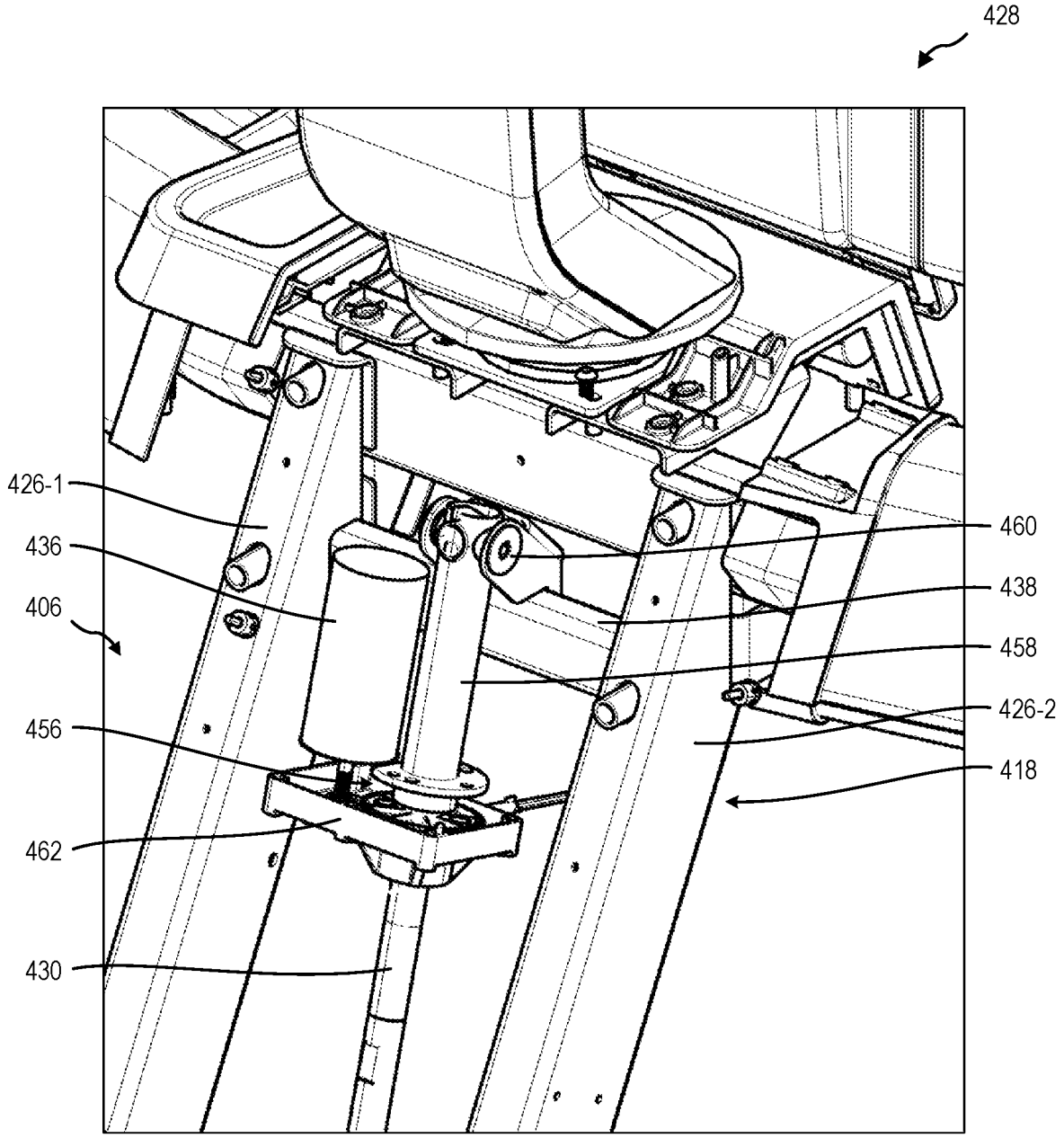
Figure 5:
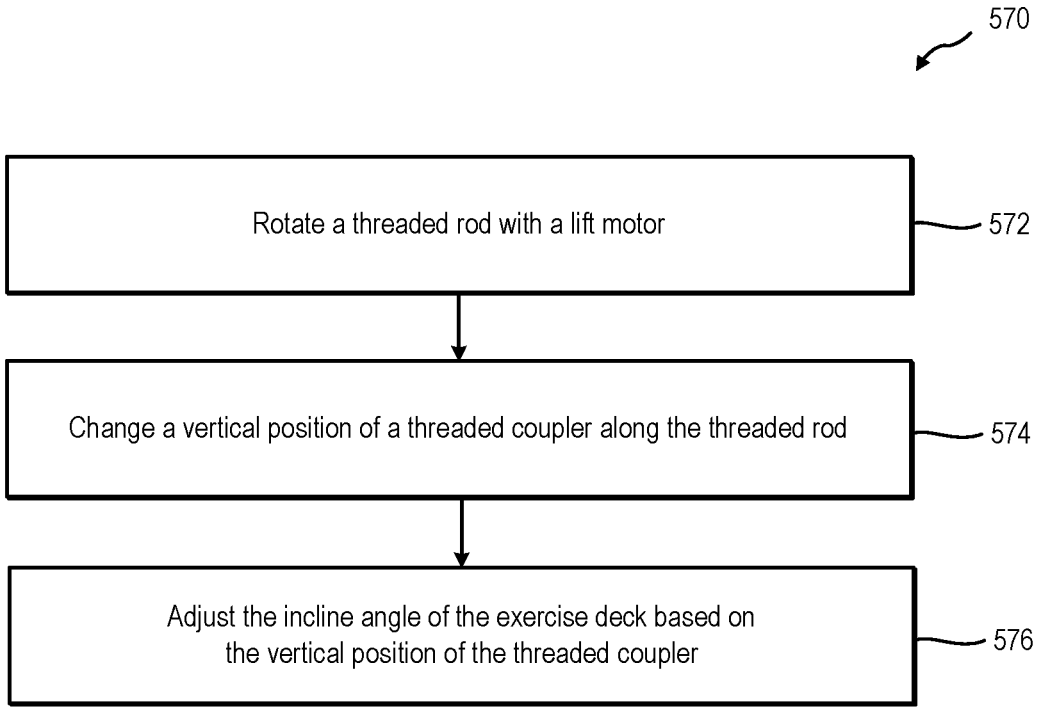

FIG. 5 is a flowchart of a method 570 for changing an incline angle of an exercise deck, according to at least one embodiment of the present disclosure. In some embodiments, the method 570 includes rotating a threaded rod with a lift motor at 572. In some embodiments, the lift motor is located above the exercise deck with the threaded rod extending through an upright structure to a front end of the exercise deck. The threaded rod may be inserted into a rod coupler connected to a lift trolley. As the threaded rod is rotated, a vertical position of the rod coupler may be changed along the threaded rod at 574. Changing the position of the rod coupler may adjust the incline angle of the exercise deck at 576.

In accordance with at least one embodiment of the present disclosure, a lift mechanism as discussed herein may be used in any type of exercise device. For example, lift mechanisms in accordance with embodiments of the present disclosure may be used in any exercise device having an adjustable incline. Exercise devices having an adjustable incline may include an elliptical machine, a stationary bicycle, any other exercise device having an adjustable incline, and combinations thereof.

Figure 6:
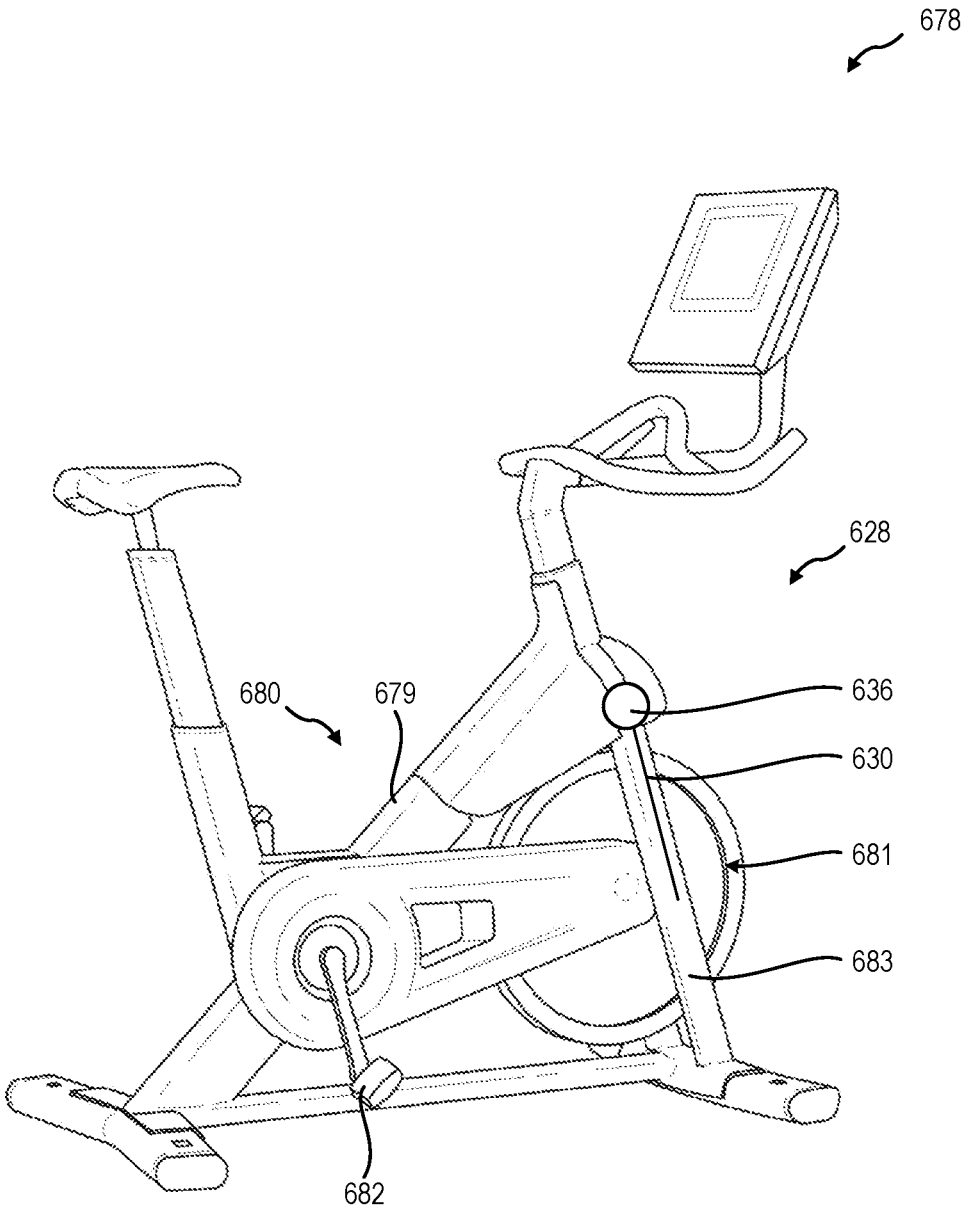
FIG. 6 is a representation of a stationary bicycle, according to at least one embodiment of the present disclosure.

FIG. 6 is a representation of a stationary bicycle 678, according to at least one embodiment of the present disclosure. The stationary bicycle 678 may include a frame 679, a drive chain 680 connected to the frame 679, and a flywheel 681 connected to the drive chain 680. A user may apply a torque to pedals 682 of the drive chain 680 to rotate the flywheel 681. The flywheel 681 may be supported on the frame 679 using a flywheel support 683. For example, the flywheel 681 may be supported by a fork or other flywheel support 683.

The stationary bicycle 678 may include a lift mechanism 628. The lift mechanism 628 may include a lift motor 636. The lift motor 636 may be connected to the frame 679 above the flywheel 681. In some embodiments, the lift motor 636 may be connected to the flywheel 681 through a threaded rod 630. For example, the threaded rod 630 may be connected to the flywheel 681 through an axle of the flywheel 681. The lift motor 636 may rotate the threaded rod 630, which may change a height of the flywheel 681 over the floor or support surface.

In some embodiments, the threaded rod 630 may be threaded into the flywheel support 683. As the threaded rod 630 is rotated, the threaded rod 630 and the flywheel support 683 may move relative to each other. For example, as the threaded rod 630 is rotated in a first direction, the lift motor 636 may move away from the flywheel support 683. The threaded rod 630 may pull the flywheel 681 up. This may change the incline of the stationary bicycle 678. As the threaded rod 630 is rotated in a second direction, the lift motor 636 may move toward the flywheel support 683, thereby decreasing the incline of the stationary bicycle 678. This may increase the stability of the stationary bicycle 678.

Figure 7:
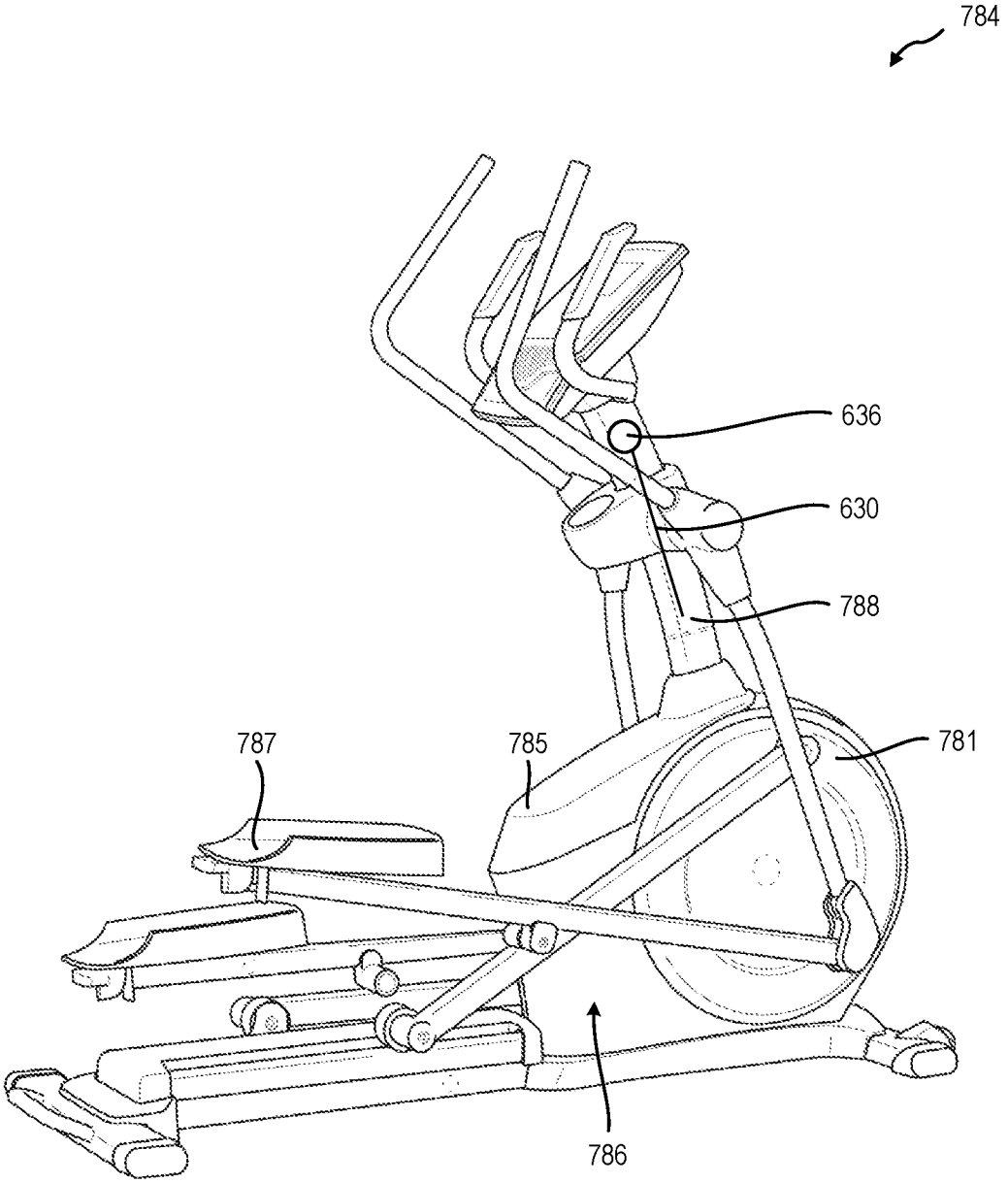
FIG. 7 is a representation of an elliptical device, according to at least one embodiment of the present disclosure.

FIG. 7 is a representation of an elliptical machine 784, according to at least one embodiment of the present disclosure. The elliptical machine 784 may include a frame 785, a drive chain 786 connected to the frame 785, and a flywheel 781 connected to the drive chain 786. A user may apply a torque to pedals 787 of the drive chain 786 to rotate the flywheel 781. The flywheel 781 may be supported on the frame 785 at an upright support 788.

The elliptical machine 784 may include a lift mechanism 728. The lift mechanism 728 may include a lift motor 736. The lift motor 736 may be connected to the 875 above the flywheel 781. In some embodiments, the lift motor 736 may be connected to the flywheel 781 through a threaded rod 730. For example, the threaded rod 730 may be connected to the flywheel 781 through an axle of the flywheel 781. The lift motor 736 may rotate the threaded rod 730, which may change a height of the flywheel 781 over the floor or support surface.

In some embodiments, the threaded rod 730 may be threaded into the upright support 788, or into a rod connector located in the upright support 788. As the threaded rod 730 is rotated, the threaded rod 730 may lift the flywheel 781 above the floor. For example, as the threaded rod 730 is rotated in a first direction, a rod connector in the upright support 788 may move upward along the threaded rod 730. This may cause the flywheel 781 to rise above the floor and increase the incline of the elliptical machine 784. In some embodiments, as the threaded rod 730 is rotated in a second direction, the rod connector in the upright support 788 may move downward along the threaded rod 730, causing the flywheel 781 to move closer to the floor and decrease the incline of the elliptical machine 784.

INDUSTRIAL APPLICABILITY

This disclosure generally relates to devices, systems, and methods for adjusting the incline angle of an exercise deck of an exercise device, such as a treadmill. An incline mechanism may be located in an upright structure of the treadmill. The incline mechanism may include a threaded rod connected to a threaded coupler on a lift trolley. The lift trolley is connected to the exercise deck. A lift motor in the upright structure may rotate the threaded rod within the threaded coupler. This may change the location of the threaded coupler to change along the length of the threaded rod, thereby changing a height of the lift trolley. As the height of the lift trolley changes, the incline angle of the exercise deck may change.

In accordance with one or more embodiments of the present disclosure, the threaded rod is placed in tension while adjusting the incline angle of the lift mechanism. This may help to increase the maximum incline angle of the exercise deck. In some embodiments, the threaded rod is anchored to an upper portion of the upright structure above the exercise deck. The threaded rod may support the weight of the front end of the exercise deck, and transfer the weight to the upper portion of the upright structure. This may place the threaded rod in tension and allow for an increased height that the front end of the exercise deck may be lifted.

In accordance with one or more embodiments of the present disclosure, the lift motor for the incline mechanism is located above the front end of the exercise deck. For example, in some embodiments, the lift motor is located in the upright structure. In some examples, the lift motor may be located in the console. This may help to reduce the "step-height" of the exercise device, or the profile of the exercise device above the ground surface.

In some embodiments, a treadmill includes a frame. The frame includes a base and an upright structure. An exercise deck includes a front pulley located at a front end of the exercise deck and a rear pulley located at a rear end of the exercise deck. A tread belt extends between the front pulley and the rear pulley. A drive motor may be connected to one or both of the front pulley or the rear pulley. Friction between the front pulley and the drive pulley and the tread belt may cause the tread belt to rotate when the drive motor rotates the pulleys. A user may walk or run forwards (e.g., while facing a console) when the tread belt rotates in a forward direction from the front end to the rear end of the exercise deck. A user may walk or run backwards (e.g., while facing the console) when the tread belt rotates in a backward direction from the rear end to the front end.

While embodiments of the present disclosure may be described with reference to a treadmill, it should be understood that this disclosure may be utilized with any exercise device. For example, an elliptical device has an exercise deck with an adjustable inclination, and the lift mechanisms described herein may be utilized on an elliptical device. In some examples, a stationary bicycle may have a lift mechanism to adjust the incline angle of the stationary bicycle. In some examples, the lift mechanism and other principles described herein may be applicable to any other exercise device.

The console may be supported by the upright structure. Put another way, the console may rest on an upper portion of the upright structure. The upright structure may be connected to the base at a lower portion of the upright structure. The console includes a display. In some embodiments, one or more handles is connected to the console and/or the upper portion of the upright structure. In some embodiments, the handles is part of the console. In some embodiments, the handles is part of the frame connected to the upright structure.

In some embodiments, the upright structure includes a first post and a second post. Both the first post and the second post may be connected to the base and support the console. In some embodiments, the first post and the second post is load-bearing, or may support at least a portion of the weight of the console and/or the handles. In some embodiments, as discussed in further detail herein, the first post and/or the second post supports at least a portion of the weight of the exercise deck. For example, the front end of the exercise deck may be suspended from the upper portion of the upright structure, or the upper portion of both of the first post and/or the second post. This may help to support the stability of the exercise deck during an exercise activity.

The treadmill includes a lift mechanism. In accordance with one or more embodiments of the present disclosure, the lift mechanism is at least partially located within the upright structure. In some embodiments, the lift mechanism is entirely or wholly located or contained within the upright structure. In some embodiments, the lift mechanism is at least partially located within the console.

The lift mechanism may include a threaded rod connected to a lift coupler. In some embodiments, the threaded rod is connected to the upright structure. In some embodiments, the threaded rod is at least partially located within the upright structure. In some embodiments, the threaded rod is entirely located within the upright structure. In some embodiments, the threaded rod is at least partially located within the console. In the embodiment shown, the threaded rod is located between the first post and the second post. In some embodiments, the threaded rod is located within the first post or the second post. In some embodiments, the upright structure includes a single post, and the threaded rod may be located within the single post.

In some embodiments, the threaded rod is supported by the upright structure. For example, the threaded rod may be connected to the upright structure such that the threaded rod transfers some or all forces applied to it to the upright structure. In some embodiments, the threaded rod is connected to the upper portion of the upright structure. In this manner, the threaded rod may be suspended from the upright structure. In some embodiments, the threaded rod is connected to the upright structure above the front end of the exercise deck. In some embodiments, the threaded rod is connected to the upright structure at any location between the upper portion and the lower portion. In some embodiments, the threaded rod is connected to the upright structure below the front end of the exercise deck.

The lift coupler may be connected to a lift trolley, and the lift trolley may be connected to the front end of the exercise deck. The lift coupler may include internal threads that are complementary to the threads on the threaded rod. The lift coupler may be rotationally fixed relative to the threaded rod. Put another way, the threaded rod may rotate within the lift coupler. To change the inclination of the exercise deck, a lift motor may rotate the threaded rod. The threaded rod may rotate within the lift coupler. The threaded connection between the threaded rod and the lift coupler may cause the lift coupler to move along the length of the threaded rod. Moving the lift coupler may change the vertical position of the lift trolley. Changing the vertical position of the lift trolley may change the vertical position of the front end of the exercise deck, thereby changing an incline angle of the exercise deck. Because the lift coupler is connected to the lift trolley, and the lift trolley is connected to front end of the exercise deck, as rotating the threaded rod may result in a change in inclination of the exercise deck.

In some embodiments, the lift motor is located at least partially within the upright structure. In some embodiments, the lift motor is located at least partially within the console. In some embodiments, the console includes one or more computing devices. The computing devices may include one or more exercise programs. An exercise program may include a series of exercise activities that a user may perform. During an exercise activity, the console may direct the tread belt to be rotated at a particular speed. The speed may be associated with a walking or running pace for the user. In some embodiments, the console directs the front end to be elevated to a particular incline angle during an exercise activity. For example, actuation of the lift motor may be controlled by one or more computing devices in the console. In some embodiments, the computing devices is controlled by one or more input devices on the console, such as a button, a switch, a toggle, a touch-sensitive screen, any other input device, and combinations thereof. In some embodiments, actuation of the lift motor is controlled by one or more input devices on any other portion of the treadmill, such as the upright structure or the handles. In some embodiments, actuation of the lift mechanism is controlled by a remote computing device, such as a mobile device, a cloud server, a network server, any other computing device, and combinations thereof. In some embodiments, the console is positioned to allow simultaneous user interaction with the console while performing an exercise activity.

In some embodiments, for a treadmill in a neutral position, the incline angle of the exercise deck is approximately or about 0° (e.g., the incline angle is approximately level). As discussed herein, the treadmill includes a lift mechanism. The lift mechanism may be located in the upright structure. In the embodiment shown, the lift mechanism is located between a first post and a second post of the upright structure.

The lift mechanism includes a lift motor coupled to a threaded rod. The lift motor may be configured to rotate the threaded rod, which may cause a change in an incline angle of an exercise deck, as discussed herein. In accordance with embodiments of the present disclosure, threaded rod may extend from the upper portion of the upright support to the exercise deck. In some embodiments, the threaded rod may be secured to an upper portion of the upright structure. In some embodiments, the lift motor may be secured to the upper portion of the upright structure. In some embodiments, a lift mount may be secured to the upper portion of the upright structure. The lift motor and/or the threaded rod may be secured to the lift mount. In some embodiments, the lift mount extends between the first post and the second post. The lift motor and/or the threaded rod may be secured to a center of the lift mount, thereby distributing any transferred load to the first post and the second post.

In some embodiments, the lift motor and the threaded rod are secured to the upright structure above the exercise deck. This may place the threaded rod in tension as the threaded rod takes on the weight of the exercise deck. Placing the threaded rod in tension may increase the stability of the lift mechanism. For example, a lift mechanism that is under compression may experience buckling, bending, flexure, or other movement especially as the length of the rod, piston, or other lift element increases to increase the incline angle. Placing the threaded rod in tension may reduce the buckling, bending, flexure, or other movement. This may help to improve the stability, and indeed the stiffness, of the exercise deck during operation. In some embodiments, placing the lift motor and the threaded rod above the exercise deck may increase the maximum incline angle of the exercise deck by increasing the stiffness of the lift mechanism.

In some embodiments, placing the lift motor and the threaded rod above the exercise deck at the front end of the exercise deck increases the maximum incline angle of the exercise deck by allowing the angle between the exercise deck and the threaded rod to remain close to 90°. In this manner, the load transferred to the threaded rod may be parallel or close to parallel to the length or the rotational axis of the threaded rod. This may further help to reduce buckling, bending, flexure, or other movement in the threaded rod, and therefore the stability of the exercise deck during operation. This increased stability of the threaded rod may alloy for a higher maximum incline angle of the exercise deck.

Conventionally, the lift mechanism is located below the exercise deck. By placing the lift mechanism above the exercise deck, a step height of the exercise deck may be decreased. The step height may be the height from a ground surface (e.g., the surface upon which the base rests) to the upper surface of the exercise deck. Reducing the step height may help to reduce the tripping hazard of the treadmill as the user mounts and dismounts the treadmill during use. In some embodiments, the minimum step height is in a range having an upper value, a lower value, or upper and lower values including any of 18 in. (45.7 cm), 20 in. (50.8 cm), 22 in. (55.9 cm), 24 in. (61.0 cm), 26 in. (66.0 cm), 28 in. (71.1 cm), 30 in. (76.2 cm), or any value therebetween. For example, the minimum step height may be greater than 18 in. (45.7 cm). In another example, the minimum step height may be less than 30 in. (76.2 cm). In yet other examples, the minimum step height may be any value in a range between 18 in. (45.7 cm) and 30 in. (76.2 cm). In some embodiments, it is critical that the minimum step height is less than or equal to 24 in. (61.0 cm) to reduce the tripping hazard of a user mounting and/or dismounting the treadmill.

The threaded rod may be connected to a lift trolley with a lift coupler. The lift coupler may include internal threads that are complementary to the threaded rod. As the lift motor rotates the threaded rod, the threaded rod may rotate within the lift coupler. The interaction of the threaded connection between the threaded rod and the lift coupler may cause the lift coupler to change position along the length of the threaded rod. For example, if the threaded rod is rotated in a first direction, then lift coupler may move up the threaded rod (e.g., toward the upper portion of the upright structure. If the threaded rod is rotated in a second direction, then the lift coupler may move down the threaded rod (e.g., toward a lower portion of the upright structure).

Because the lift coupler is connected to the lift trolley, when the lift coupler moves along the length of the threaded rod, then the lift trolley may change a vertical position. The lift trolley is connected to the front end of the exercise deck. Thus, as the lift trolley changes vertical position, the front end of the exercise deck may change vertical position. Changing the position of the front end of the exercise deck may change the incline angle of the exercise deck. Thus, the incline angle of the exercise deck may be changed by rotating the threaded rod with the lift motor.

The lift trolley may include one or more stabilizers. The stabilizers may include one or more wheels that engage with the upright structure. In some embodiments, the stabilizers, and in particular the wheels, stabilize the lateral position of the exercise deck relative to the upright structure. As the lift trolley changes vertical position, the stabilizers and the wheels may engage the upright structure to maintain the lateral position of the exercise deck. In some embodiments, the lift trolley includes two stabilizers that engage with either side of the upright structure. In some embodiments, the upright structure includes one or more guide tracks. In some embodiments, the front end of the exercise deck is slidably coupled to the one or more guide tracks. For example, the stabilizers may be slidably coupled to the one or more guide tracks. The guide tracks may help to guide the stabilizers and/or the wheels and maintain the position of the lift trolley.

In some embodiments, a bottom of the threaded rod is free-floating. For example, the bottom of the threaded rod may not be connected to any structure of the treadmill, including the base, the upright structure, the lift trolley, the exercise deck, any other structure of the treadmill, and combinations thereof. This may allow the bottom freedom of movement as the vertical position of the lift coupler changes.

In some embodiments, the threaded rod extends between the first post and the second post. However, it should be understood that the threaded rod may be located in any position. For example, the threaded rod may be inserted into a post of the upright structure. In some embodiments, the lift mechanism includes two or more threaded rods. For example, the lift mechanism may include two threaded rods. This may reduce the load on each rod, thereby allowing for a smaller threaded rod. In some embodiments, the two threaded rods extend through the posts of the upright structure.

In some embodiments, to move a treadmill from the neutral position to the inclined position, the lift motor rotates the threaded rod. As the threaded rod rotates, the lift coupler may travel up the threaded rod (e.g., toward the upper end of the upright structure). This may cause the connected lift trolley to move upwards, thereby lifting the front end of the exercise deck upward. In the inclined position shown, the front end of the exercise deck is raised above the base with a front end height. The rear end of the exercise deck may remain connected to the base. In this manner, as the front end height increases, the incline angle of the exercise deck may be increased.

In some embodiments, the maximum front end height is in a range having an upper value, a lower value, or upper and lower values including any of 36 in. (91.4 cm), 38 in. (96.5 cm), 40 in. (1.02 m), 42 in. (1.07 m), 44 in. (1.12 m), 46 in. (1.17 m), 48 in. (1.22 m), 50 in. (1.27 m), 52 in. (1.32 m), 54 in. (1.37 m), or any value therebetween. For example, the maximum front end height may be greater than 36 in. (91.4 cm). In another example, the maximum front end height may be less than 54 in. (1.37 m). In yet other examples, the maximum front end height may be any value in a range between 36 in. (91.4 cm) and 54 in. (1.37 m). In some embodiments, it is critical that the maximum front end height is greater than or equal to 48 in. (1.22 m) to increase the available incline angles for the user. The maximum front end height may be increased over conventional systems because of the placement of the lift mechanism above the exercise deck.

In some embodiments, a threaded rod is connected to the upright structure at an upper end of the upright structure with a pivot connection. The threaded rod may be connected to the front end of the exercise deck with a pivot connection. As may be seen, the threaded rod and the exercise deck may form a rod angle.

As the front end of the exercise deck is lifted upward, the rear end of the exercise deck may remain connected to the base. This may cause the front end to follow a curved path upward. The upright structure may include a guide that follows the curved path. By connecting the threaded rod to the upright structure and the front end of the exercise deck with pivot connections, the threaded rod may remain connected to both the upright structure and the exercise deck. Furthermore, the rod angle may change and the height of the front end may change.

In the incline position, the exercise deck forms an incline angle with the base. In some embodiments, the maximum incline angle is in a range having an upper value, a lower value, or upper and lower values including any of 30°, 32°, 34°, 36°, 38°, 40°, 42°, 44°, 45°, 50°, 55°, or any value therebetween. For example, the maximum incline angle may be greater than 30°. In another example, the maximum incline angle may be less than 55°. In yet other examples, the maximum incline angle may be any value in a range between 30° and 55°. In some embodiments, it is critical that the maximum incline angle is greater than or equal to 45° to increase the available incline angles for the user.

As discussed herein, in the incline position, the rod angle may be different than in the neutral position. In some embodiments, the rod angle is in a range having an upper value, a lower value, or upper and lower values including any of 60°, 65°, 70°, 75°, 80°, 85°, 90°, 95°, 100°, or any value therebetween. For example, the rod angle may be greater than 60°. In another example, the rod angle may be less than 100°. In yet other examples, the rod angle may be any value in a range between 60° and 100°. In some embodiments, it is critical that the rod angle is between 70° and 90° to increase the stability of the treadmill by orienting the supporting force of the threaded rod in line with the length of the threaded rod 230.

In some embodiments a rod angle change is the change in rod angle between the neutral position and the incline position. In some embodiments, the rod angle change is in a range having an upper value, a lower value, or upper and lower values including any of 1°, 2°, 4°, 6°, 8°, 10°, 12°, 14°, 15°, or any value therebetween. For example, the rod angle change may be greater than 1°. In another example, the rod angle change may be less than 15°. In yet other examples, the rod angle change may be any value in a range between 1° and 15°. In some embodiments, it is critical that the rod angle change is less than 10° to improve the stability of the treadmill by orienting the supporting force of the threaded rod 230 in line with the length of the threaded rod.

In accordance with one or more embodiments of the present disclosure, the exercise deck is secured at any position or incline angle between the neutral position to the maximum incline angle. Put another way, the exercise deck may be secured with the front end of the exercise deck at any height above the base. This may allow the user to perform exercise activities at any incline angle or front end height. In some embodiments, the front end of the exercise deck is supported by the threaded rod while the user is performing an exercise activity. Put another way, the lift mechanism may support the weight of the user transferred through the front end of the exercise deck. In this manner, the incline angle may be fluidly adjustable in any position between the neutral position and the incline position.

In some embodiments, the upright structure and/or the guide track includes one or more locking positions between the neutral position and the incline position. In the locking position, a mechanical interlock may secure the front end of the exercise deck to the upright structure. This may help to directly transfer the weight of the user and the front end to the upright structure without placing additional strain on the lift mechanism. In some embodiments, the mechanical interlock includes any type of mechanical interlock. For example, the mechanical interlock may include a pin and socket. A pin may be inserted into a socket, thereby supporting the front end of the exercise device. In some embodiments, the pin is located on the front end of the exercise deck or the lift trolley and the socket may be located on the upright structure (e.g., one or both of the first post or the second post). In some embodiments, the pin is located on the upright structure (e.g., one or both of the first post or the second post) and the socket may be located on the front end of the exercise deck or the lift trolley. In some embodiments, any mechanical interlock may be used to create a locking position. In some embodiments, the locking position is positioned at regular intervals, such as every 1°, 1.5°, 2°, 2.5°, 3°, 3.5°, 4°, 4.5°, 5°, or any value therebetween.

In some embodiments, a rear incline mechanism lifts the rear end of the exercise deck. The front end of the exercise deck is located at the lower portion of the upright structure. This may allow for a negative incline angle, or a decline angle. In some embodiments, the maximum decline angle is in a range having an upper value, a lower value, or upper and lower values including any of 5°, 10°, 15°, 20°, 25°, 30°, or any value therebetween. For example, the maximum decline angle may be greater than 5°. In another example, the maximum decline angle may be less than 30°. In yet other examples, the maximum decline angle may be any value in a range between 5° and 30°. In some embodiments, it is critical that the maximum decline angle is greater than 15° to improve the exercise experience for the user.

In some embodiments, the lift coupler is connected to the lift trolley with a lift coupler bracket. In some embodiments, the lift coupler bracket is connected to the lift trolley with a weld, braze, a mechanical fastener, any other connection, or combinations thereof. In some embodiments, the lift coupler is connected to the lift coupler bracket with a pivoting connection. The pivoting connection may secure the lift coupler so that the lift coupler does not rotate relative to the lift trolley and allow the threaded rod to rotate with thin the lift coupler. In some embodiments, the pivoting connection allows the lift coupler to rotate with the threaded rod as the orientation of the threaded rod changes with the height of the lift trolley.

In some embodiments, a lift motor is connected to the upper portion of an upright structure. The upright structure may include a first post and a second post. A lift mount may be connected to and extend between the first post and the second post. The lift motor and a threaded rod may be connected to the lift mount. The lift mount, and through the lift mount the first post and the second post, may support the weight and any connected loads (such as the exercise deck) of the threaded rod.

In some embodiments, the lift motor is connected to the threaded rod with a geared connection. However, it should be understood that the lift motor may be connected to the threaded rod with any other type of connection. In some embodiments, the lift motor is directly connected to the threaded rod. In some embodiments, the threaded rod is connected to the lift mount with a rod connector. In some embodiments, the rod connector is connected to the lift mount with a rod pivot. The rod pivot may allow the rod connector and the connected threaded rod to pivot as the height of the exercise deck changes. In some embodiments, the rod connector is connected to the threaded rod with a rotating connection. In some embodiments, the rod connector includes a bearing, such as a thrust bearing.

In some embodiments, the rod connector includes a motor support. The motor support may include a platform upon which the lift motor rests. The motor support may pivot with the rod connector as the height of the exercise deck changes. In this manner, the lift motor may pivot as the height of the exercise deck changes. In some embodiments, the lift motor is directly connected to the lift mount with its own pivot connection.

According to one or more embodiments of the present disclosure, a method for changing an incline angle of an exercise deck is described. In some embodiments, the method includes rotating a threaded rod with a lift motor. In some embodiments, the lift motor is located above the exercise deck with the threaded rod extending through an upright structure to a front end of the exercise deck. The threaded rod may be inserted into a rod coupler connected to a lift trolley. As the threaded rod is rotated, a vertical position of the rod coupler may be changed along the threaded rod. Changing the position of the rod coupler may adjust the incline angle of the exercise deck.

In some embodiments, a stationary bicycle may include a frame, a drive chain connected to the frame, and a flywheel connected to the drive chain. A user may apply a torque to pedals of the drive chain to rotate the flywheel. The flywheel may be supported on the frame using a flywheel support. For example, the flywheel may be supported by a fork or other flywheel support.

The stationary bicycle may include a lift mechanism. The lift mechanism may include a lift motor. The lift motor may be connected to the frame above the flywheel. In some embodiments, the lift motor may be connected to the flywheel through a threaded rod. For example, the threaded rod may be connected to the flywheel through an axle of the flywheel. The lift motor may rotate the threaded rod, which may change a height of the flywheel over the floor or support surface.

In some embodiments, the threaded rod may be threaded into the flywheel support. As the threaded rod is rotated, the threaded rod and the flywheel support may move relative to each other. For example, as the threaded rod is rotated in a first direction, the lift motor may move away from the flywheel support. The threaded rod may pull the flywheel up. This may change the incline of the stationary bicycle. As the threaded rod is rotated in a second direction, the lift motor may move toward the flywheel support, thereby decreasing the incline of the stationary bicycle. This may increase the stability of the stationary bicycle.

In some embodiments, an elliptical machine may include a frame, a drive chain connected to the frame, and a flywheel connected to the drive chain. A user may apply a torque to pedals of the drive chain to rotate the flywheel. The flywheel may be supported on the frame at an upright support.

The elliptical machine may include a lift mechanism. The lift mechanism may include a lift motor. The lift motor may be connected to the above the flywheel. In some embodiments, the lift motor may be connected to the flywheel through a threaded rod. For example, the threaded rod may be connected to the flywheel through an axle of the flywheel. The lift motor may rotate the threaded rod, which may change a height of the flywheel over the floor or support surface.

In some embodiments, the threaded rod may be threaded into the upright support, or into a rod connector located in the upright support. As the threaded rod is rotated, the threaded rod may lift the flywheel above the floor. For example, as the threaded rod is rotated in a first direction, a rod connector in the upright support may move upward along the threaded rod. This may cause the flywheel to rise above the floor and increase the incline of the elliptical machine. In some embodiments, as the threaded rod is rotated in a second direction, the rod connector in the upright support may move downward along the threaded rod, causing the flywheel to move closer to the floor and decrease the incline of the elliptical machine.

Following are sections in accordance with one or more embodiments of the present disclosure:

A1. An exercise device comprising:

an upright support having a base and a top end;

an exercise deck having a front end and a rear end, the front end being slidable along the upright support between the base and the top end;

a console connected to the upright support at the top end; and an incline mechanism located in the upright support, wherein the incline mechanism is connected to the front end of the exercise deck and the top end of the upright support.

A2. The exercise device of section A1, wherein the incline mechanism is entirely located within the upright support.

A3. The exercise device of section A1 or A2, wherein the exercise device includes a treadmill.

A4. The exercise device of any of sections A1-A3, wherein the console is supported by the upright support.

A5. The exercise device of any of sections A1-A4, wherein the console comprises a computing device for controlling the incline mechanism.

A6. The exercise device of any of sections A1-A5, wherein the incline mechanism is actuated with an lift motor.

A7. The exercise device of section A6, wherein the lift motor is located in the upright support.

A8. The exercise device of section A6 or A7, wherein the lift motor is located at the top end of the upright support.

A9. The exercise device of any of sections A6-A8, wherein the lift motor is located in the console.

A10. The exercise device of any of sections A6-A9, wherein the lift motor is located in the exercise deck.

11 The exercise device of any of sections A1-A10, wherein the console is positioned to allow simultaneous user interaction with the console while performing an exercise activity.

A12. The exercise device of any of sections A1-11, wherein the incline mechanism includes a threaded rod that extends from the top end of the upright support to the exercise deck.

A13. The exercise device of section A12, wherein the threaded rod includes an upper end connected to the upright support at the top end and a lower end that is free-floating.

A14. The exercise device of section A12 or A13, wherein the exercise deck includes a lift coupler connected to the front end and the threaded rod is threaded into the lift coupler such that a rotation of the threaded rod adjusts a vertical position of the lift coupler along the threaded rod.

A15. The exercise device of any of sections A1-A14, wherein the incline mechanism includes at least one of a screw, a worm gear, a hydraulic actuator, a pneumatic actuator, or a rack and pinion.

A16. The exercise device of any of sections A1-A15, wherein in the neutral position the exercise deck has an incline angle that is substantially level, and in the positive position the incline angle is positive.

A17. The exercise device of section A16, wherein in the positive position the incline angle is between 0° and 45°.

A18. The exercise device of section A16 or A17, wherein in the positive position the front end of the exercise base is raised 48 inches.

A19. The exercise device of any of sections A1-A18, wherein the incline mechanism is configured to position the exercise base at discrete locations between a neutral position and a maximum incline angle.

A20. The exercise device of any of sections A1-A19, wherein the incline mechanism is configured to position the exercise base at any location between the neutral position and a maximum positive position.

A21. The exercise device of any of sections A1-A20, wherein the incline mechanism is configured to position the exercise base while a user is performing an exercise activity with the exercise device.

A22. The exercise device of any of sections A1-A21, wherein the incline mechanism is configured to support the weight of a user using the exercise base at the positive position.

A23. The exercise device of any of sections A1-A22, wherein the upright support includes a guide track, and wherein the exercise deck is slidably coupled to the guide track.

A24. The exercise device of section A23, wherein the exercise deck includes a guide trolley that slides along the guide track when the incline mechanism changes an inclination angle of the exercise deck.

A25. The exercise device of section A24, wherein the guide trolley is configured to travel along the at least one guide track in conjunction with the positive position of the exercise base.

A26. The exercise device of section A24 or A25, wherein the guide trolley and the guide track include a mechanical lock in at least one fixed position along the guide track.

A27. The exercise device of any of sections A24-A26, wherein the guide trolley is configured to be locked at any position along the first guide track.

A28. The exercise device of any of sections A1-A26, wherein the incline mechanism is a front incline mechanism and further comprising a rear incline mechanism connected to the rear end of the exercise deck, wherein the rear incline mechanism is configured to position the exercise base between a neutral position and a decline position.

A29. The exercise device of section A28, wherein, in the decline position, the rear end of the exercise base is raised higher than the front end of the exercise deck.

A30. The exercise device of section A28 or A29, wherein, in the decline position, an incline angle of the exercise deck is negative.

A31. The exercise device of section A30, wherein, in the decline position, the incline angle is between 0° and −30°.

A32. The exercise device of any of sections A28-A31, wherein, in the decline position, the rear end is raised 24 higher than in the neutral position.

A33. The exercise device of any of sections A28-A32, wherein the rear incline mechanism includes at least one of a screw, a worm gear, a hydraulic actuator, a pneumatic actuator, or a rack and pinion.

A34. The exercise device of any of sections A28-A33, wherein the front incline mechanism and the rear incline mechanism are actuated with the same motor.

A35. The exercise device of any of sections A28-A34, wherein the rear incline mechanism is actuated with a rear lift motor.

A36. The exercise device of any of sections A28-A35, wherein the rear incline mechanism is configured to position the exercise base while the exercise device is in use.

A37. The exercise device of any of sections A28-A36, wherein the front incline mechanism and the rear incline mechanism are configured to simultaneously position the exercise base.

A38. The exercise device of any of sections A28-A37, wherein the console comprises a computing device for controlling the rear inclined device.

A39. The exercise device of any of sections A1-A38, wherein the exercise device includes an elliptical device.

A40. The exercise device of any of sections A1-A38, wherein the exercise device includes a stationary bicycle.

B1. A treadmill, comprising:

an upright support including a base and a top;

an exercise deck having a front end and a rear end;

a front pulley located at the front end of the exercise deck and a rear pulley located at the rear end of the exercise deck;

a tread belt between the front pulley and the rear pulley;

a drive motor connected to at least one of the front pulley or the rear pulley;

a console connected to the top of the upright support; and an incline mechanism, including:

a lift motor;

a threaded rod coupled to the lift motor;

a lift trolley connected to the front end of the exercise deck and slidably connected to the upright support; and a lift coupler threaded to the threaded rod, the lift coupler being connected to the lift trolley.

B2. The treadmill of section B1, wherein at least a portion of the threaded rod is contained within the console.

B3. The treadmill of section B1 or B2, wherein at least a portion of the threaded rod is contained within the upright support.

B4. The treadmill of any of sections B1-B3, wherein the threaded rod is configured to position the exercise deck between a neutral position and an inclined position.

B5. The treadmill of any of sections B1-B4, wherein the console is separated from a base of the exercise device by the upright support.

B6. The lifting device of any of sections B1-B5, wherein the lift coupler comprises internal threads that complementary with the threaded rod and moves along the helical screw based on a rotation of the helical screw.

B7. The lifting device of any of sections B1-B6, wherein the threaded rod is configured to change an inclination of the exercise deck by raising or lowering the lift trolley.

B8. The lifting device of any of sections B1-B7, wherein the lift coupler comprises a pivoting connection to the exercise deck to accommodate an incline angle of the exercise deck in the positive position.

B9. The lifting device of any of sections B1-B8, wherein the lift motor is rotationally connected to the threaded rod with at least one of a belt and pulley, chain and sprocket, spur, bevel, rack, spiral, worm, or planetary gear.

B10. The lifting device of any of sections B1-B9, wherein the lift motor is located within the console.

B11. The lifting device of any of sections B1-B10, wherein the lift motor is located within the support base B12. The lifting device of any of sections B1-B11, wherein the threaded rod is pivotally connected to the upright support.

B13. The lifting device of any of sections B1-B12, wherein the threaded rod is pivotally connected to the support base.

B14. The exercise device of any of sections B1-B13, wherein in the neutral position, the exercise deck is substantially level in the positive position the front end of the exercise base higher than the rear end.

B15. The lifting device of any of sections B1-B14, further comprising a rear incline mechanism connected to the rear end of the exercise deck.

B16. The lifting device of any of sections B1-B15, wherein the rear incline mechanism is configured to position the exercise base between a neutral position and a decline position.

B17. The lifting device of any of sections B1-B16, wherein, in the decline position, the rear end of the exercise deck is raised so higher than the front end of the exercise deck.

B18. The exercise device of any of sections B1-B17, wherein the decline position corresponds to a negative angle relative to the neutral position and the incline position corresponds to a positive angle relative to the neutral position.

C1. A method for changing an incline angle of an exercise deck, comprising;

rotating a threaded rod with a lift motor, the lift motor being located above the exercise deck and the threaded rod extends through an upright support to a front end of the exercise deck, the threaded rod being inserted into a threaded coupler connected to a lift trolley;

changing a vertical position of the threaded coupler along the threaded rod based on rotating the threaded rod; and adjusting the incline angle of the exercise deck based on the vertical position of the threaded coupler.

C2. The method of section C1, wherein actuating the lift motor includes actuating the lift motor within the console.

C3. The method of section C1 or C2, wherein actuating the lift motor includes actuating the lift motor within the support base.

C4. The method of any of sections C1-C3, wherein changing the vertical position of the threaded coupler includes adjusting the vertical position of the threaded couple within the upright support.

C5. The method of any of sections C1-C4, further comprising moving the lift trolley along a guide track connected to the upright support.

C6. The method of any of sections C1-C5, further comprising pivoting the support base about a rear end, the rear end being opposite front end.

C7. The method of any of sections C1-C6, further comprising adjusting a rear incline mechanism connected to the second side of the exercise deck.

C8. The method of any of sections C1-C7, further comprising raising a rear end of the exercise deck.

C9. The method of any of sections C1-C8, further comprising moving the exercise deck into a decline position by raising the rear end of the exercise deck.

C10. The method of section C9, wherein raising the rear end of the exercise deck includes actuating the lift motor.

C11. The method of section C9 or C10, wherein raising the rear end includes actuating a rear lift motor connected to the rear incline mechanism.

C12. The method of section C11, further comprising pivoting the exercise deck about the front end while raising the rear end.

C13. The method of any of sections C1-C12, wherein adjusting the incline angle occurs while performing an exercise activity.

C14. The method of any of sections C1-C13, further comprising raising the first side of the exercise base to a height of 48 inches or less relative to the neutral position.

C15. The method of any of sections C1-C14, further comprising raising the second side of the exercise base to a height of 24 inches or less relative to the neutral position.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. An exercise device, comprising:

an upright support that comprises a base and a top end, two posts, and two guide tracks;

an exercise deck having a front end and a rear end, wherein the front end is slidable along the upright support between the base and the top end based on being slidably coupled with the two guide tracks;

a console connected to the upright support at the top end; and an incline mechanism located in the upright support, wherein the incline mechanism is connected to the front end of the exercise deck and the top end of the upright support, and wherein the incline mechanism comprises:

a lift motor, configured to actuate the incline mechanism, located at the top end of the upright support and above the exercise deck; and a threaded rod that is coupled to the lift motor, that is located between the two posts, and that comprises an upper end connected to the upright support at the top end and a lower end that is free-floating within the upright support.

2. The exercise device of claim 1, wherein the incline mechanism is entirely located within the upright support.

3. The exercise device of claim 1, wherein the exercise device includes a treadmill.

4. The exercise device of claim 1, wherein a maximum incline of the incline mechanism is about 45°.

5. The exercise device of claim 1, wherein a maximum front end height of the front end of the exercise deck is 48 in.

6. The exercise device of claim 1, wherein the incline mechanism is a front incline mechanism and further comprising a rear incline mechanism connected to the rear end of the exercise deck, wherein the rear incline mechanism is configured to position the exercise deck between a neutral position and a decline position.

7. The exercise device of claim 6, wherein, in the decline position, a decline angle is between 0° and −30°.

8. A treadmill, comprising:

an upright support that comprises a base and a top end, two posts, and two guide tracks;

an exercise deck having a front end and a rear end, wherein the front end is slidable along the upright support between the base and the top end based on being slidably coupled with the two guide tracks;

a front pulley located at the front end of the exercise deck and a rear pulley located at the rear end of the exercise deck;

a tread belt between the front pulley and the rear pulley;

a drive motor connected to at least one of the front pulley or the rear pulley;

a console connected to the top end of the upright support; and an incline mechanism, comprising:

a lift motor, configured to actuate the incline mechanism, located at the top end of the upright support and above the exercise deck;

a threaded rod that is coupled to the lift motor, that is located between the two posts, and that comprises an upper end connected to the upright support at the top end and a lower end that is free-floating within the upright support;

a lift trolley connected to the front end of the exercise deck and slidably connected to the upright support; and a lift coupler threaded to the threaded rod, the lift coupler being connected to the lift trolley.

9. The treadmill of claim 8, wherein at least a portion of the threaded rod is located within the upright support.

10. The treadmill of claim 8, wherein the lift coupler comprises internal threads that complementary with the threaded rod and moves along the threaded rod based on a rotation of the threaded rod.

11. The treadmill of claim 8, wherein the lift coupler comprises a pivoting connection to the exercise deck.

12. The treadmill of claim 8, wherein the lift motor is located in within the upright support.

13. A method for changing an incline angle of an exercise deck, comprising:

rotating a threaded rod with a lift motor, wherein the lift motor is located at a top end of an upright support and above the exercise deck, and wherein the threaded rod extends through the upright support to a front end of the exercise deck, the threaded rod being inserted into a threaded coupler connected to a lift trolley, and the upright support comprising two posts and two guide tracks;

changing a vertical position of the threaded coupler along the threaded rod based on rotating the threaded rod with the lift motor, wherein the threaded rod is located between the two posts and comprises an upper end connected to the upright support at the top end and a lower end that is free-floating within the upright support;

moving the lift trolley along the two guide tracks based on changing the vertical position of the threaded coupler along the threaded rod; and adjusting the incline angle of the exercise deck based on the vertical position of the threaded coupler and moving the lift trolley along the two guide tracks, wherein the front end of the exercise deck is slidably coupled with the two guide tracks.

14. The method of claim 13, wherein changing the vertical position of the threaded coupler includes adjusting the vertical position of the threaded coupler within the upright support.

15. The method of claim 13, wherein actuating the lift motor includes actuating the lift motor within a console.

* * * * *